US010553065B2

(12) United States Patent
Sato et al.

(10) Patent No.: US 10,553,065 B2
(45) Date of Patent: Feb. 4, 2020

(54) MONEY MANAGEMENT SYSTEM, MONEY HANDLING APPARATUS, AND MONEY MANAGEMENT METHOD

(71) Applicant: GLORY LTD., Hyogo (JP)

(72) Inventors: Hiroshi Sato, Himeji (JP); Masayuki Kanagawa, Himeji (JP)

(73) Assignee: GLORY LTD., Hyogo (JP)

( * ) Notice: Subject to any disclaimer, the term of this patent is extended or adjusted under 35 U.S.C. 154(b) by 0 days.

(21) Appl. No.: 15/776,647

(22) PCT Filed: Oct. 24, 2016

(86) PCT No.: PCT/JP2016/081386
§ 371 (c)(1),
(2) Date: May 16, 2018

(87) PCT Pub. No.: WO2017/086093
PCT Pub. Date: May 26, 2017

(65) Prior Publication Data

US 2018/0350183 A1 Dec. 6, 2018

(30) Foreign Application Priority Data

Nov. 18, 2015 (JP) ..... 2015-225498

(51) Int. Cl.

| | |
|---|---|
| ***G07D 11/34*** | (2019.01) |
| ***G07D 11/16*** | (2019.01) |
| ***G07D 11/23*** | (2019.01) |
| ***G07F 19/00*** | (2006.01) |

(52) U.S. Cl.
CPC ..... *G07D 11/34* (2019.01); *G07D 11/16* (2019.01); *G07D 11/23* (2019.01); *G07F 19/203* (2013.01)

(58) Field of Classification Search
None
See application file for complete search history.

(56) References Cited

FOREIGN PATENT DOCUMENTS

| | | |
|---|---|---|
| GB | 2217086 A | 10/1989 |
| JP | 5125136 | 1/2013 |
| JP | 2015-92326 | 5/2015 |
| JP | 2015-125474 | 7/2015 |
| WO | 2011/145691 | 11/2011 |

OTHER PUBLICATIONS

Official Communication issued in International Patent Application No. PCT/JP2016/081386, dated Jan. 24, 2017, along with English translation.
European Search Report, European Patent Office, Application No. 16866095.9, dated Jun. 25, 2019.
Japanese Office Action in counterpart Application No. JP2015-225498, dated Jul. 1, 2019 (along with English-language translation).

*Primary Examiner* — Kristy A Haupt
(74) *Attorney, Agent, or Firm* — Greenblum & Bernstein, P.L.C.

(57) ABSTRACT

A first money handling apparatus (for example, money change machine) has a first writing unit that writes information on an inventory amount of money in the first money handling apparatus, in a storage medium disposed at a storage cassette. A second money handling apparatus (for example, money depositing/dispensing machine) has a second reading unit (for example, reading unit) that reads information from the storage medium disposed at the storage cassette, and an inventory amount management unit that manages an inventory amount of money in the first money handling apparatus based on the information read by the second reading unit.

11 Claims, 15 Drawing Sheets

MONEY MANAGEMENT SYSTEM, MONEY HANDLING APPARATUS, AND MONEY MANAGEMENT METHOD

TECHNICAL FIELD

The present invention relates to a money management system that includes a first money handling apparatus, such as a money change machine, which performs money depositing and money dispensing, and a second money handling apparatus, such as a cashier machine, which performs at least money dispensing. The present invention further relates to a money handling apparatus such as a cashier machine disposed in such a money management system, and a money management method performed by such a money management system.

BACKGROUND ART

In stores of commercial facilities such as supermarkets and convenience stores, a money change machine is installed in a settlement place in a front region where store shelves are arranged, and a depositing/dispensing machine such as a cashier machine is installed in a back office region which customers are not allowed to enter. The money change machine installed in the settlement place in the front region can perform depositing of money delivered for a commodity from a customer to a clerk, and can perform dispensing of money as change. Furthermore, the depositing/dispensing machine, such as a cashier machine, installed in the back office region performs depositing of money collected from the money change machine as proceeds from a sale, and performs dispensing of money with which the money change machine is to be replenished as change replenishment money.

To date, various types of money management systems in each of which a money change machine installed in the front region and a depositing/dispensing machine installed in the back office region are combined with each other, have been used. For example, Japanese Patent No. 5125136 discloses a cash management system that includes at least one money change machine, a cash handling device that performs depositing of money collected from the money change machine, and a cash data management device that manages information on the inventory amount of money for each denomination as change which is stored in the money change machine, information on the necessary amount of money for each denomination as change being in the money change machine, and information on the deposited monetary amount in the cash handling device. In such a cash management system, the cash data management device notifies the cash handling device of information on an amount of money for each denomination as change replenishment money, with which the money change machine is to be replenished, on the basis of the inventory amount data transmitted from the money change machine, and the cash handling device dispenses money as change replenishment money with which the money change machine is to be replenished, on the basis of the information of which notification is made by the cash data management device. Furthermore, when money is collected from the money change machine as proceeds from a sale, the cash data management device calculates, for example, an amount and a monetary amount of money, for each denomination, to be collected from the money change machine, on the basis of an inventory amount of money in the money change machine and the necessary specific change money (that is, information on an amount of money for each denomination to be left in the money change machine as change), and notifies the money change machine of the information obtained by the calculation. The money change machine dispenses money to be collected, on the basis of the information of which the notification has been made by the cash data management device.

SUMMARY OF THE INVENTION

However, the conventional money management system as disclosed in Japanese Patent No. 5125136 has a problem that the cash data management device is necessary and the cost for installation and the cost for maintenance are increased in the entirety of the system. Furthermore, in a case where a plurality of the money change machines is disposed, another money change machine different from the money change machine to be replenished with money dispensed from the cash handling device as change may be replenished with the dispensed money by mistake.

The present invention is made in view of the aforementioned problem, and an object of the present invention is to provide a money management system, a money handling apparatus, and a money management method that allow a second money handling apparatus to manage an inventory amount of money in a first money handling apparatus off-line without using a data management device, and allow the cost for installation and the cost for maintenance to be reduced in the entirety of the system.

Another object of the present invention is to provide a money management system that allows the second money handling apparatus to manage, off-line, information on an amount of money for each denomination, which is insufficient as change in the first money handling apparatus without using a data management device.

A money management system of the present invention includes a first money handling apparatus configured to perform money depositing and money dispensing, a second money handling apparatus configured to perform at least money dispensing, and a storage cassette configured to store money and feed out the stored money, the storage cassette having a storage medium and being capable to be detachably mounted to each of the first money handling apparatus and the second money handling apparatus, the first money handling apparatus has a first writing unit configured to write information on an inventory amount of money being in the first money handling apparatus in the storage medium when the storage cassette is mounted to the first money handling apparatus, and the second money handling apparatus has a second reading unit configured to read the information written in the storage medium when the storage cassette is mounted to the second money handling apparatus, and an inventory amount management unit configured to manage an inventory amount of money being in the first money handling apparatus based on the information read by the second reading unit.

In the money management system of the present invention, the second money handling apparatus may further include a memory unit configured to memorize information on an amount of money for each denomination as a change fund in the first money handling apparatus, and a calculation unit configured to calculate for each denomination, an amount of money as change replenishment money to be deposited in the first money handling apparatus, based on an inventory amount of money being in the first money handling apparatus and managed by the inventory amount management unit, and the information memorized in the memory unit.

In this case, the second money handling apparatus may further include a display unit that displays information on an amount of money for each denomination calculated by the calculation unit as change replenishment money.

Further, the second money handling apparatus may dispense an amount of money for each denomination, calculated by the calculation unit as change replenishment money when receiving a dispensing instruction after information on the amount of money for each denomination as the change replenishment money is displayed on the display unit.

Further, the second money handling apparatus may dispense an amount of money for each denomination calculated by the calculation unit as change replenishment money when the storage cassette is mounted to the second money handling apparatus and information is read from the storage medium by the second reading unit.

Further, the second money handling apparatus may cause the storage cassette to store dispensed money as change replenishment money.

Further, the second money handling apparatus may further include a second writing unit that writes information on change replenishment money calculated by the calculation unit, in the storage medium disposed at the storage cassette when the storage cassette is mounted to the second money handling apparatus.

In this case, the first money handling apparatus may further include a first reading unit that reads information on change replenishment money from the storage medium disposed at the storage cassette when the storage cassette is mounted to the first money handling apparatus.

Further, the first money handling apparatus may further include a comparison unit that performs comparison between an amount of money for each denomination deposited in the first money handling apparatus as change replenishment money, and an amount of money for each denomination as change replenishment money based on the information read from the storage medium by the first reading unit.

Further, the second money handling apparatus may further include a proceeds management unit that manages information on money deposited in the first money handling apparatus as proceeds based on information on an inventory amount of money being in the first money handling apparatus, read from the storage medium by the second reading unit, and information on change replenishment money written in the storage medium by the second writing unit.

In the money management system as described above, the storage cassette may store a banknote, the first writing unit of the first money handling apparatus may write, in the storage medium disposed at the storage cassette information on inventory amounts of banknotes and coins being in the first money handling apparatus when the storage cassette is mounted to the first money handling apparatus, the second reading unit of the second money handling apparatus may read from the storage medium disposed at the storage cassette information on inventory amounts of banknotes and coins in the first money handling apparatus when the storage cassette is mounted to the second money handling apparatus, and the inventory amount management unit of the second money handling apparatus may manage inventory amounts of banknotes and coins being in the first money handling apparatus based on the information read by the second reading unit.

In the money management system as described above, the first writing unit of the first money handling apparatus may also write information on a state of the first money handling apparatus, in the storage medium disposed at the storage cassette, when the storage cassette is mounted to the first money handling apparatus.

An another money management system of the present invention includes a first money handling apparatus configured to perform money depositing and money dispensing, a second money handling apparatus configured to perform at least money dispensing, and a storage cassette that stores money and feeds out stored money is detachably mounted to each of the first money handling apparatus and the second money handling apparatus, the storage cassette has a storage medium, the first money handling apparatus has a first writing unit that writes information on an amount of insufficient money for each denomination being in the first money handling apparatus as a change fund, in the storage medium disposed at the storage cassette, when the storage cassette is mounted to the first money handling apparatus, and the second money handling apparatus has a second reading unit configured to read information from the storage medium disposed at the storage cassette when the storage cassette is mounted to the second money handling apparatus, and a change replenishment money management unit configured to manage an amount of money for each denomination as change replenishment money to be deposited in the first money handling apparatus, based on the information read by the second reading unit.

A money handling apparatus of the present invention that performs at least money dispensing, includes a storage cassette configured to store money and feed out the stored money, the storage cassette having a storage medium and being capable of be mounted to the money handling apparatus, a reading unit configured to read information from the storage medium disposed at the storage cassette when the storage cassette is mounted to the money handling apparatus, and an inventory amount management unit configured to manage an inventory amount of money in another money handling apparatus which is disposed separately from the money handling apparatus, based on the information read by the reading unit.

A money management method of the present invention performed by a money management system including a first money handling apparatus configured to perform money depositing and money dispensing, a second money handling apparatus configured to perform at least money dispensing, and a storage cassette which is capable of being detachably mounted to each of the first money handling apparatus and the second money handling apparatus and which is configured to store money and feed out stored money, and the storage cassette has a storage medium, the money management method includes the steps of: writing information on an inventory amount of money in the first money handling apparatus, in the storage medium disposed at the storage cassette, when the storage cassette is mounted to the first money handling device, and reading information from the storage medium disposed at the storage cassette when the storage cassette is mounted to the second money handling apparatus, and managing, by the second money handling apparatus, an inventory amount of money in the first money handling apparatus based on the information having been read.

DESCRIPTION OF THE PREFERRED EMBODIMENTS

Figure 1:
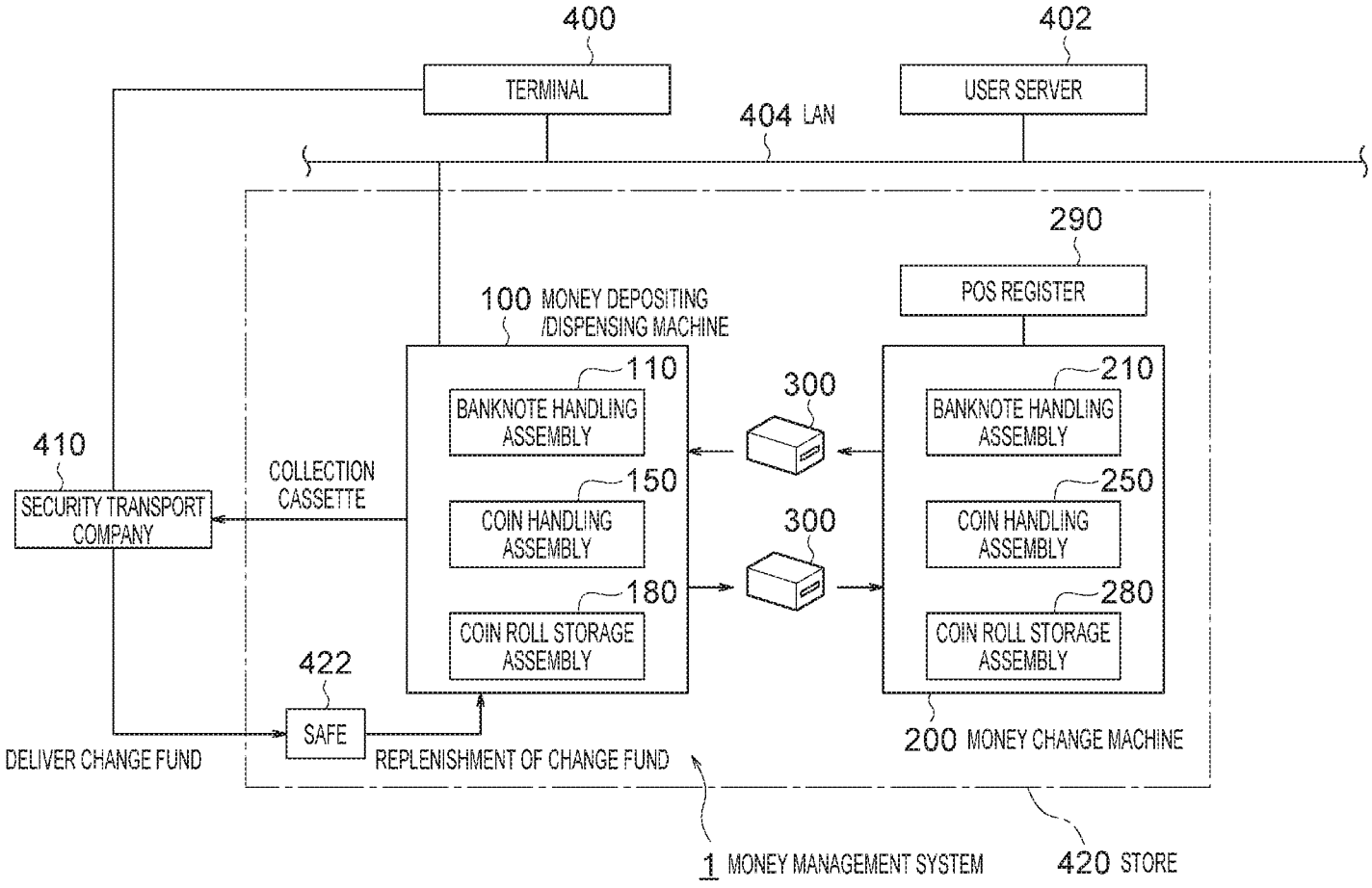
FIG. 1 schematically illustrates a configuration of a money management system according to an embodiment of the present invention.
Figure 2:
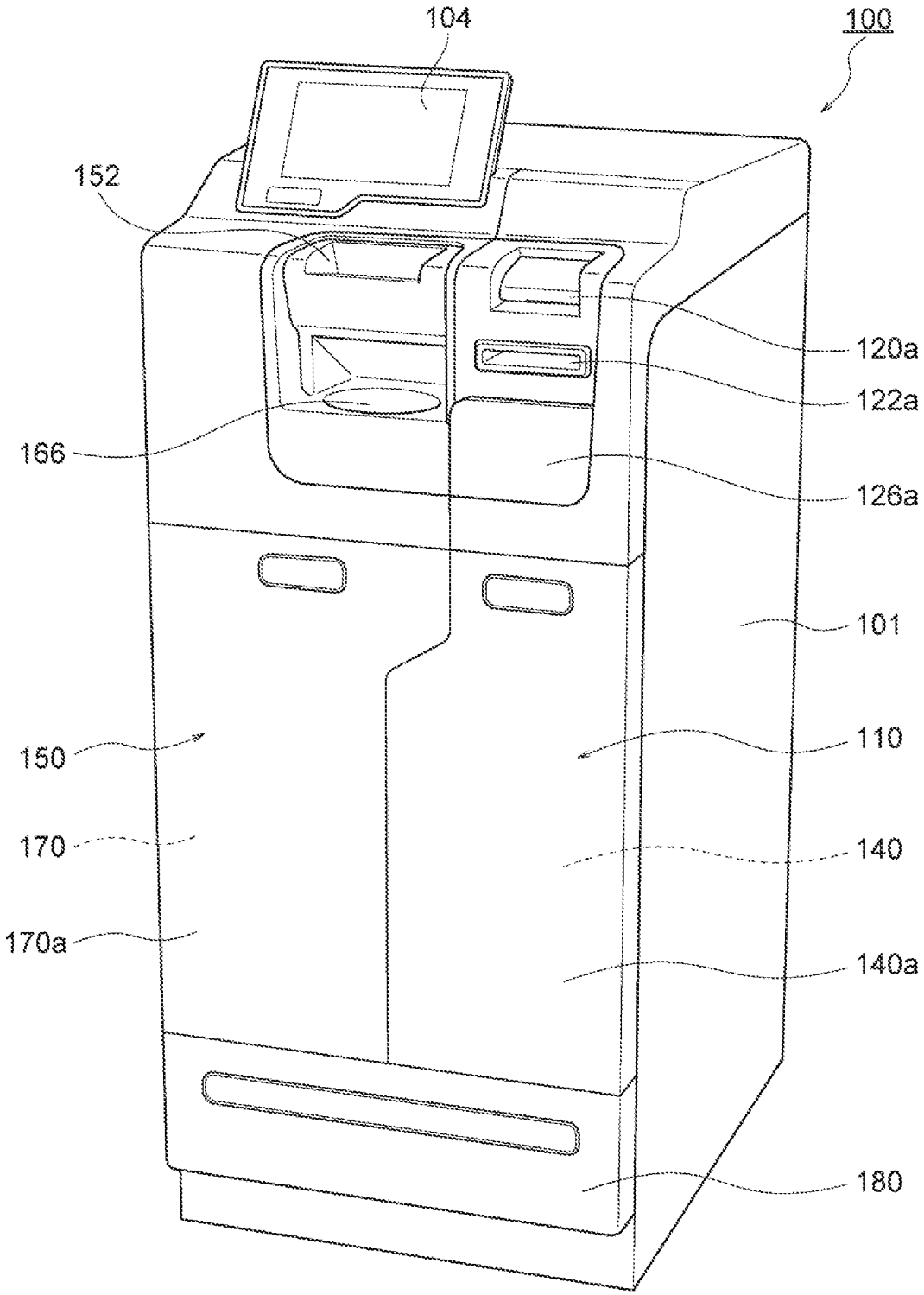
FIG. 2 is a perspective view of an outer appearance of a money depositing/dispensing machine in the money management system shown in FIG. 1.
Figure 3:
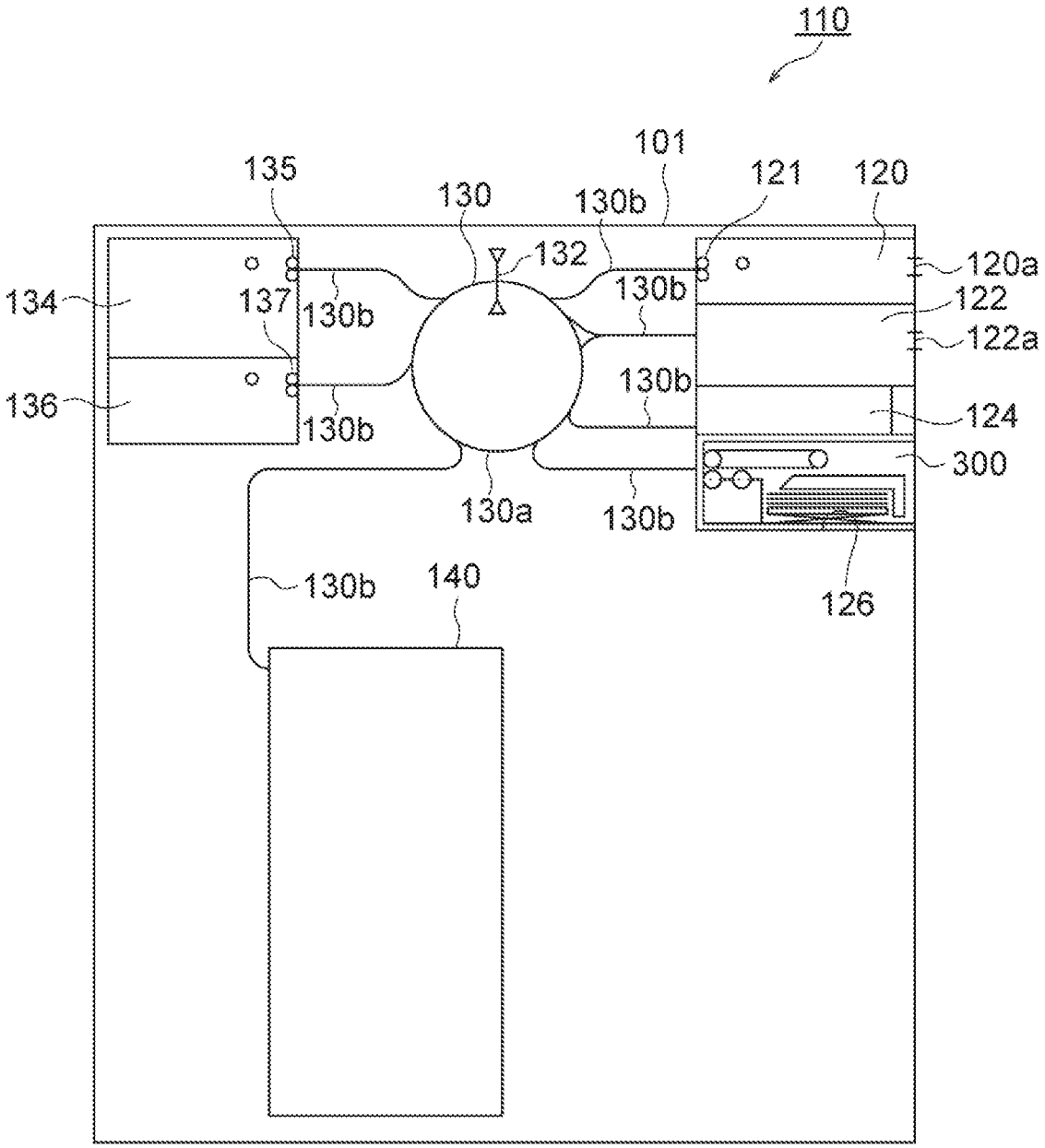
FIG. 3 illustrates an internal configuration of a banknote handling assembly in the money depositing/dispensing machine shown in FIG. 2, as viewed from the side thereof.
Figure 4:
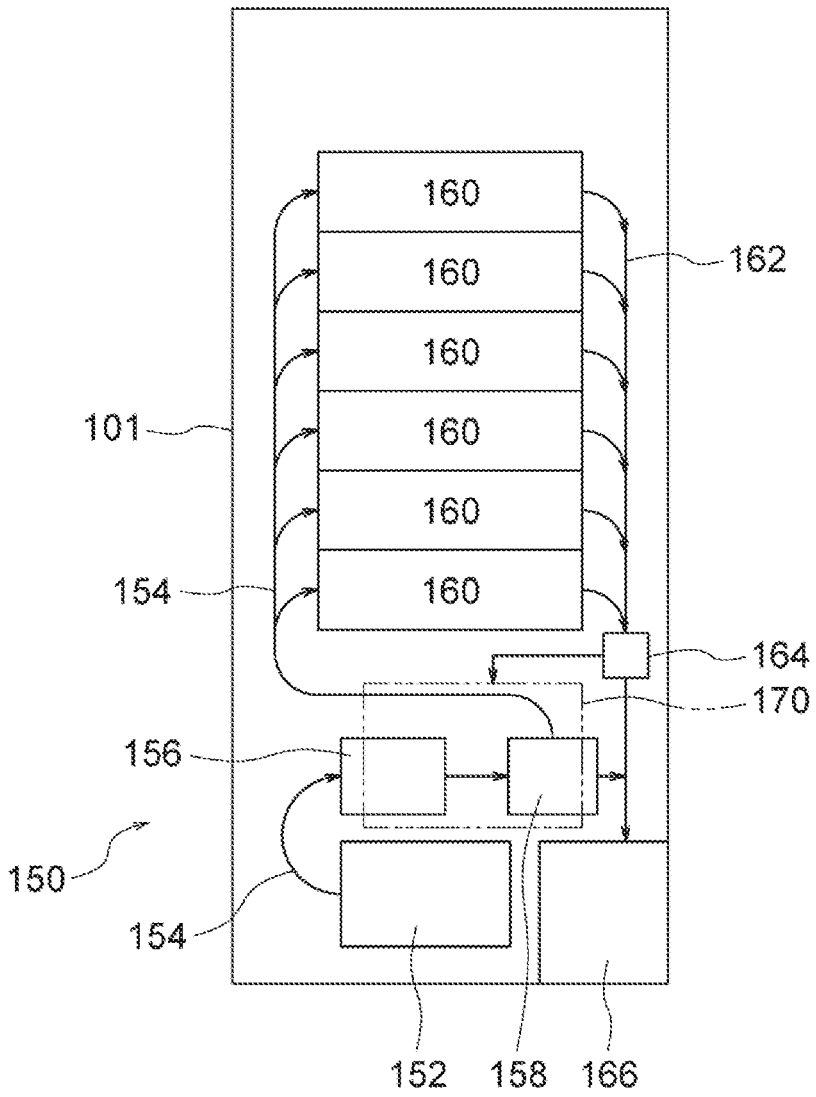
FIG. 4 illustrates an internal configuration of a coin handling assembly in the money depositing/dispensing machine shown in FIG. 2, as viewed from thereabove.
Figure 5:
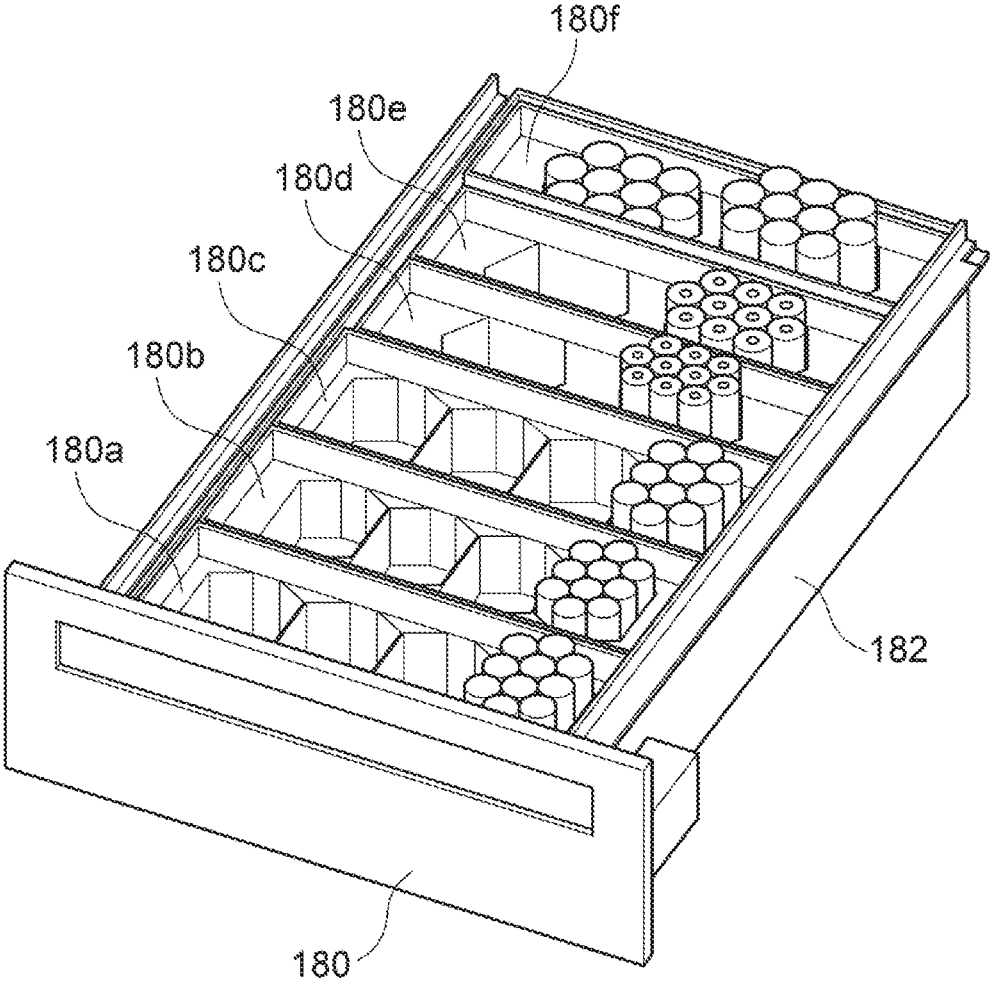
FIG. 5 is a perspective view of a configuration of a drawer unit of a coin roll storage assembly in the money depositing/dispensing machine shown in FIG. 2.
Figure 6:
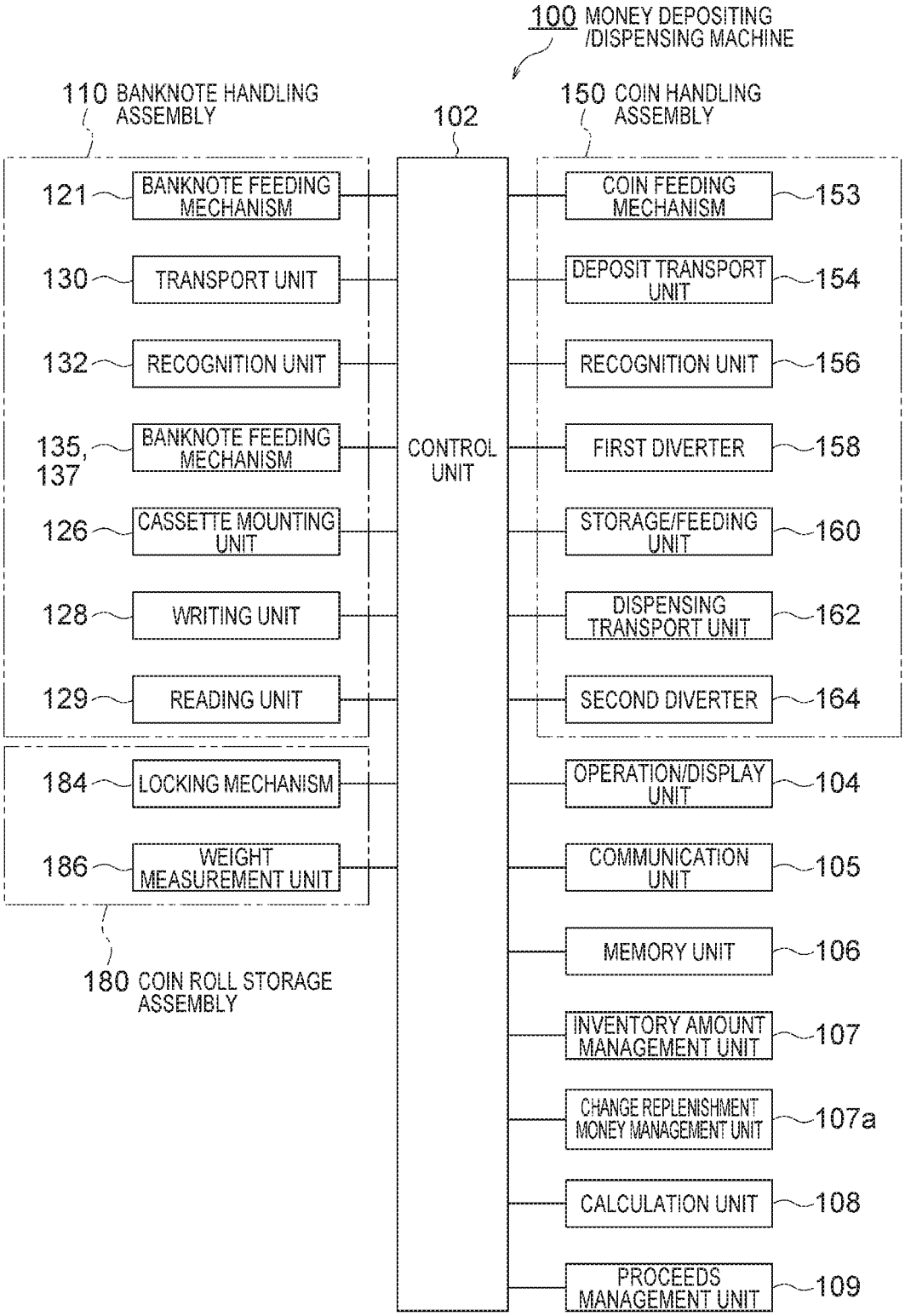
FIG. 6 is a functional block diagram illustrating a configuration of a control system in the money depositing/dispensing machine shown in FIG. 2.
Figure 7:
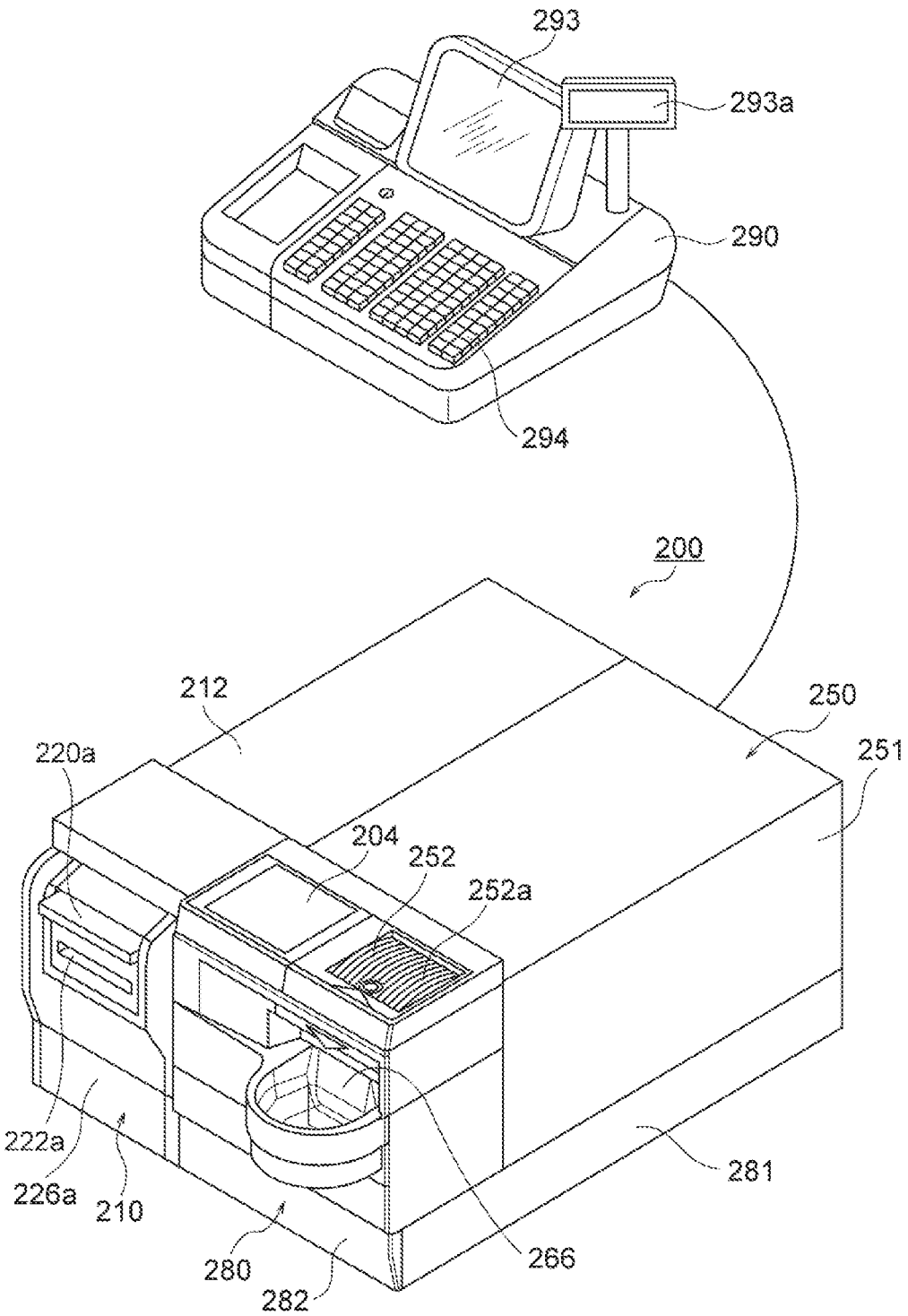
FIG. 7 is a perspective view of outer appearances of a money change machine and a POS register in the money management system shown in FIG. 1.
Figure 8:
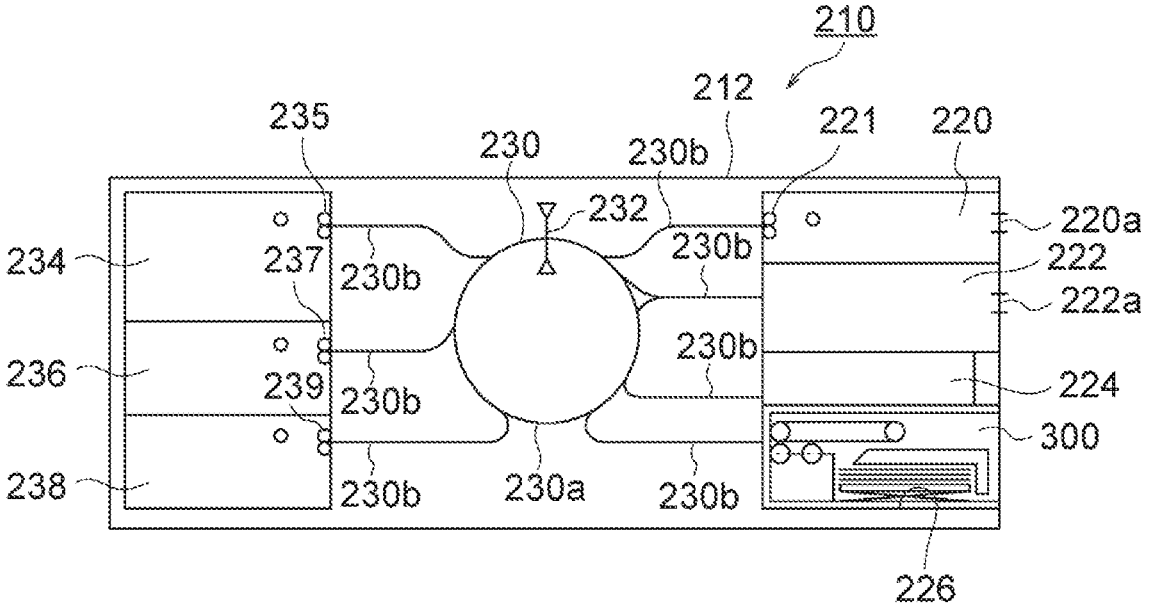
FIG. 8 illustrates an internal configuration of a banknote handling assembly in the money change machine shown in FIG. 7, as viewed from the side thereof.
Figure 9:
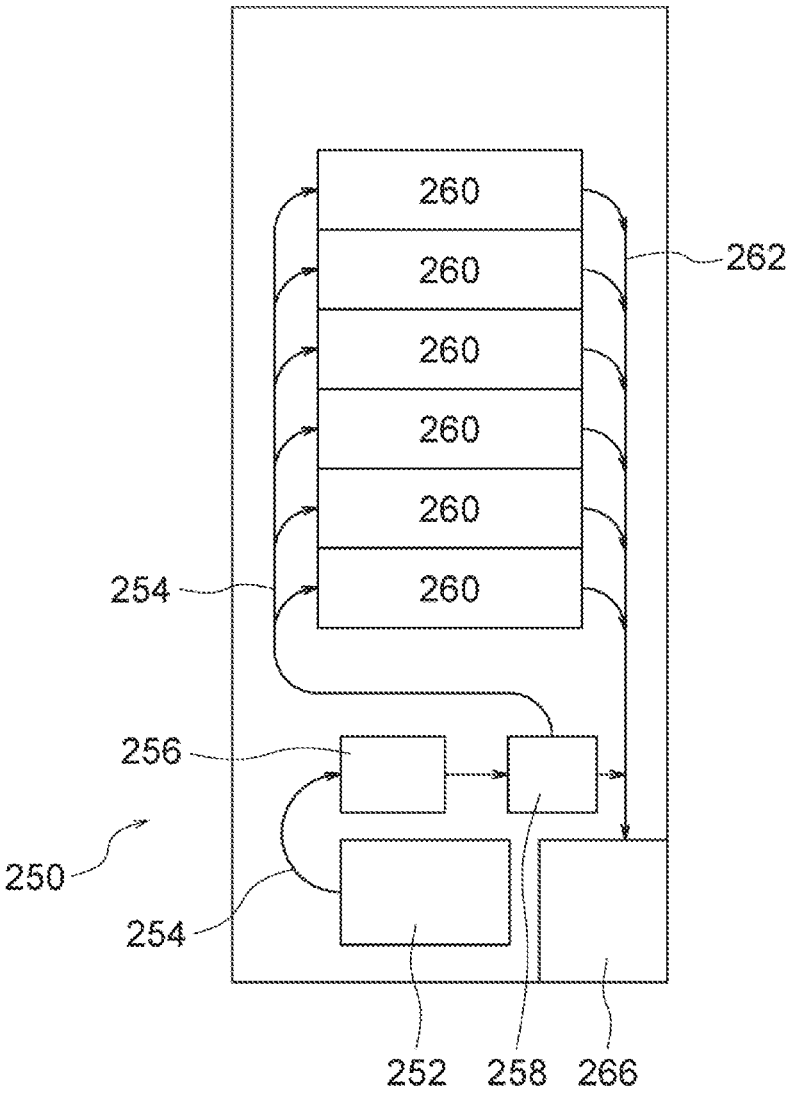
FIG. 9 illustrates an internal configuration of a coin handling assembly in the money change machine shown in FIG. 7, as viewed from thereabove.
Figure 10:
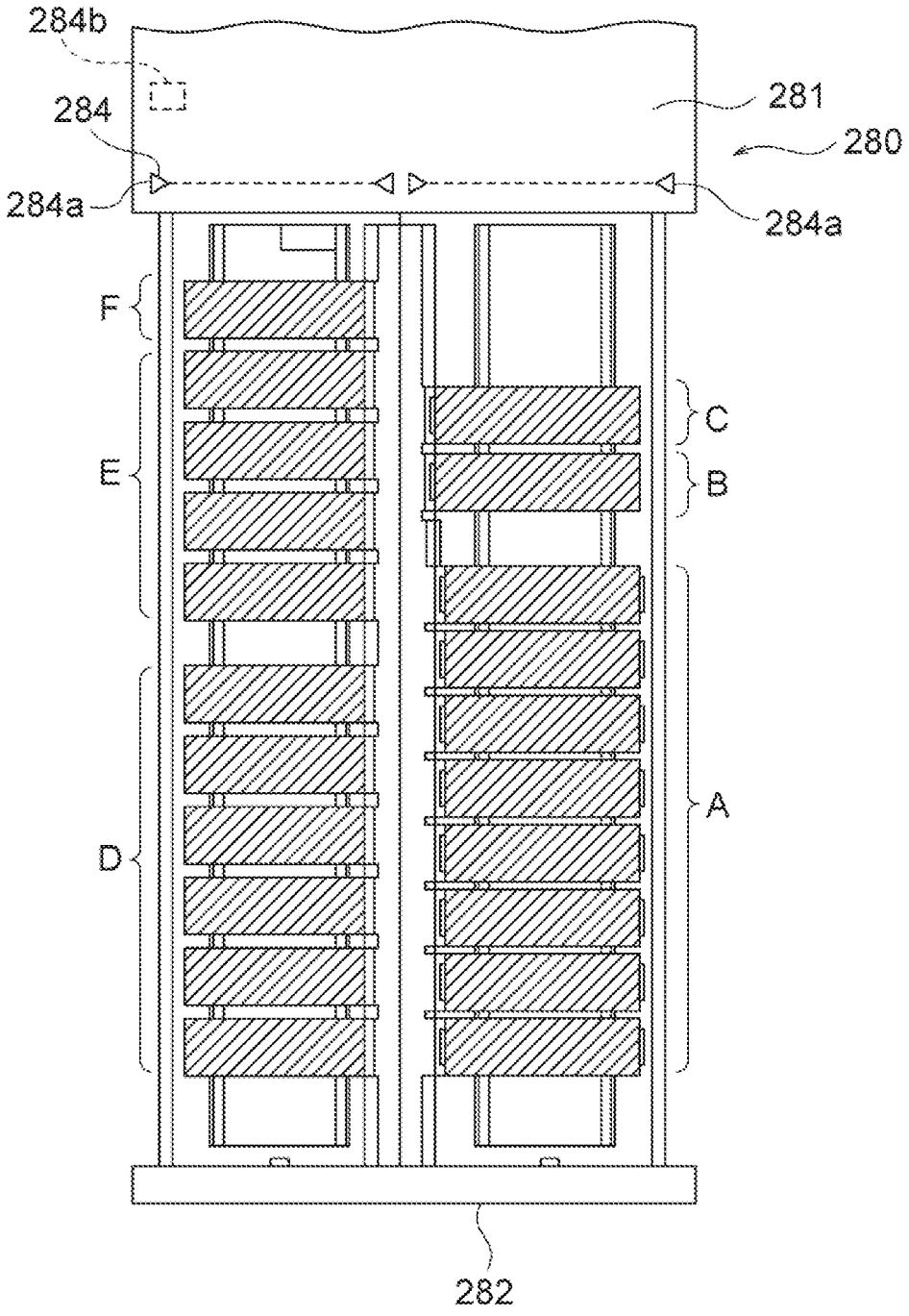
FIG. 10 illustrates a configuration of a storage drawer, of a coin roll storage assembly, which is drawn from a housing in the money change machine shown in FIG. 7, as viewed from thereabove.
Figure 11:
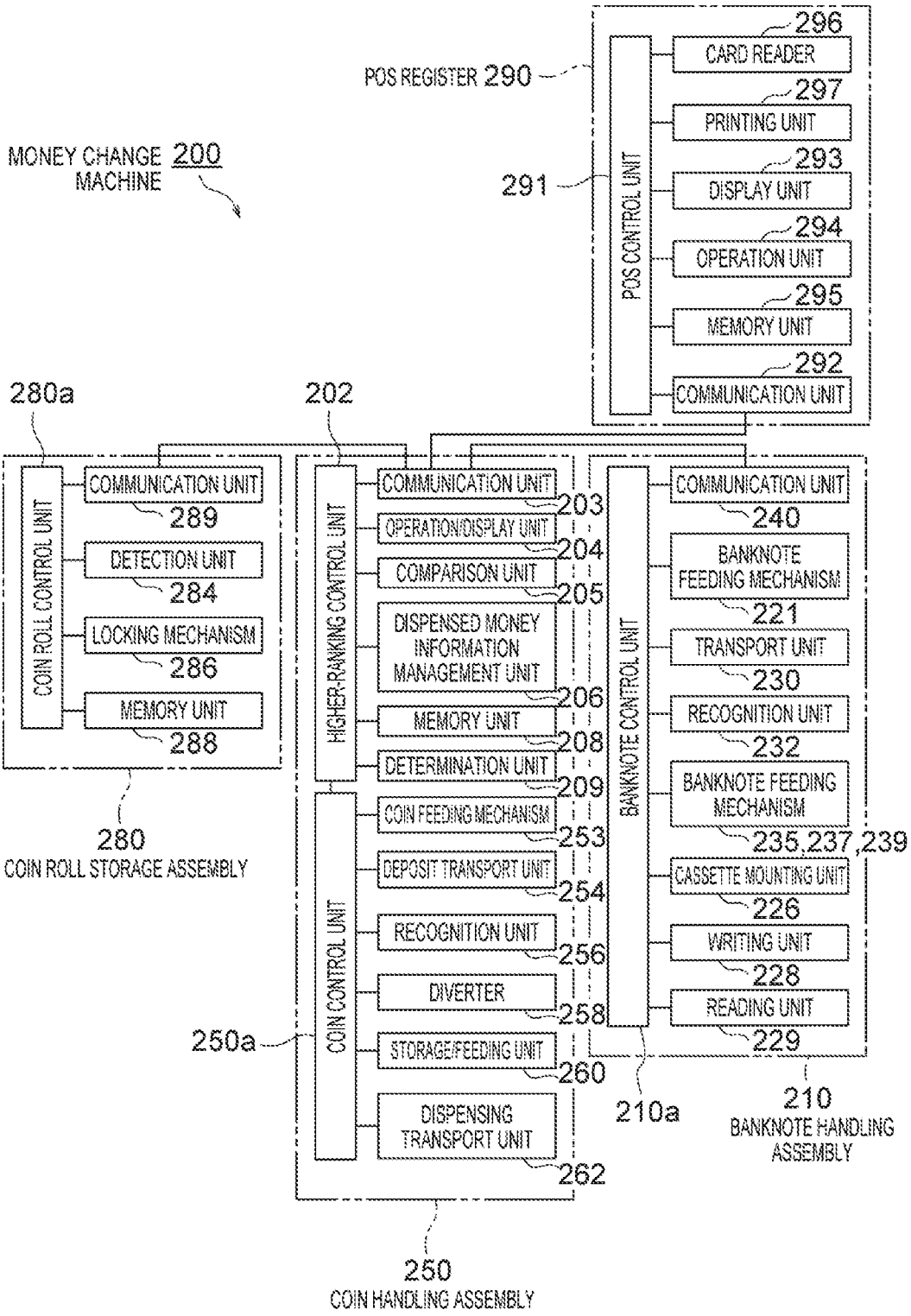
FIG. 11 is a functional block diagram illustrating a configuration of a control system in the money change machine and the POS register shown in FIG. 7.
Figure 12:
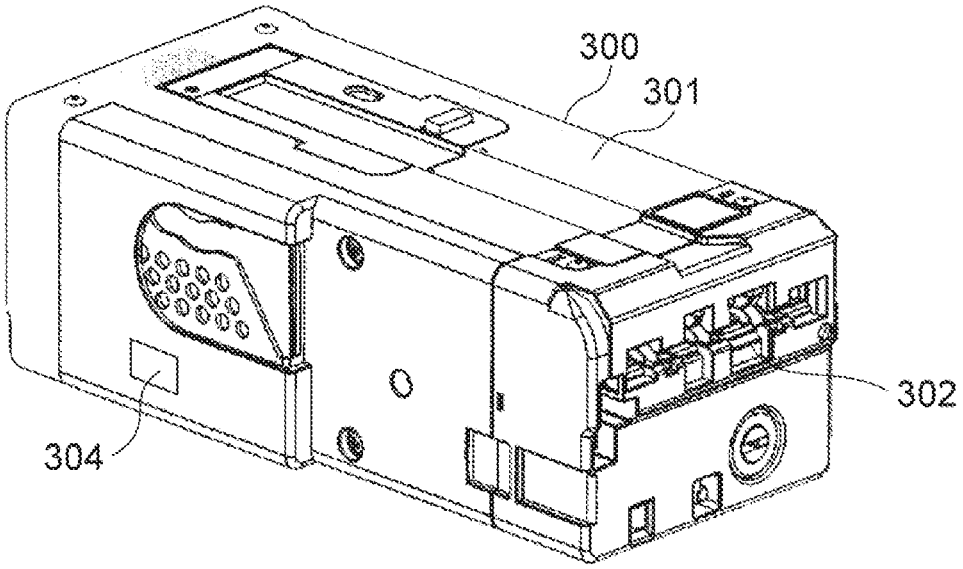
FIG. 12 is a perspective view of an outer appearance of a storage cassette that is detachably mounted to a cassette mounting unit of the money depositing/dispensing machine and a cassette mounting unit of the money change machine in the money management system shown in FIG. 1.
Figure 13:
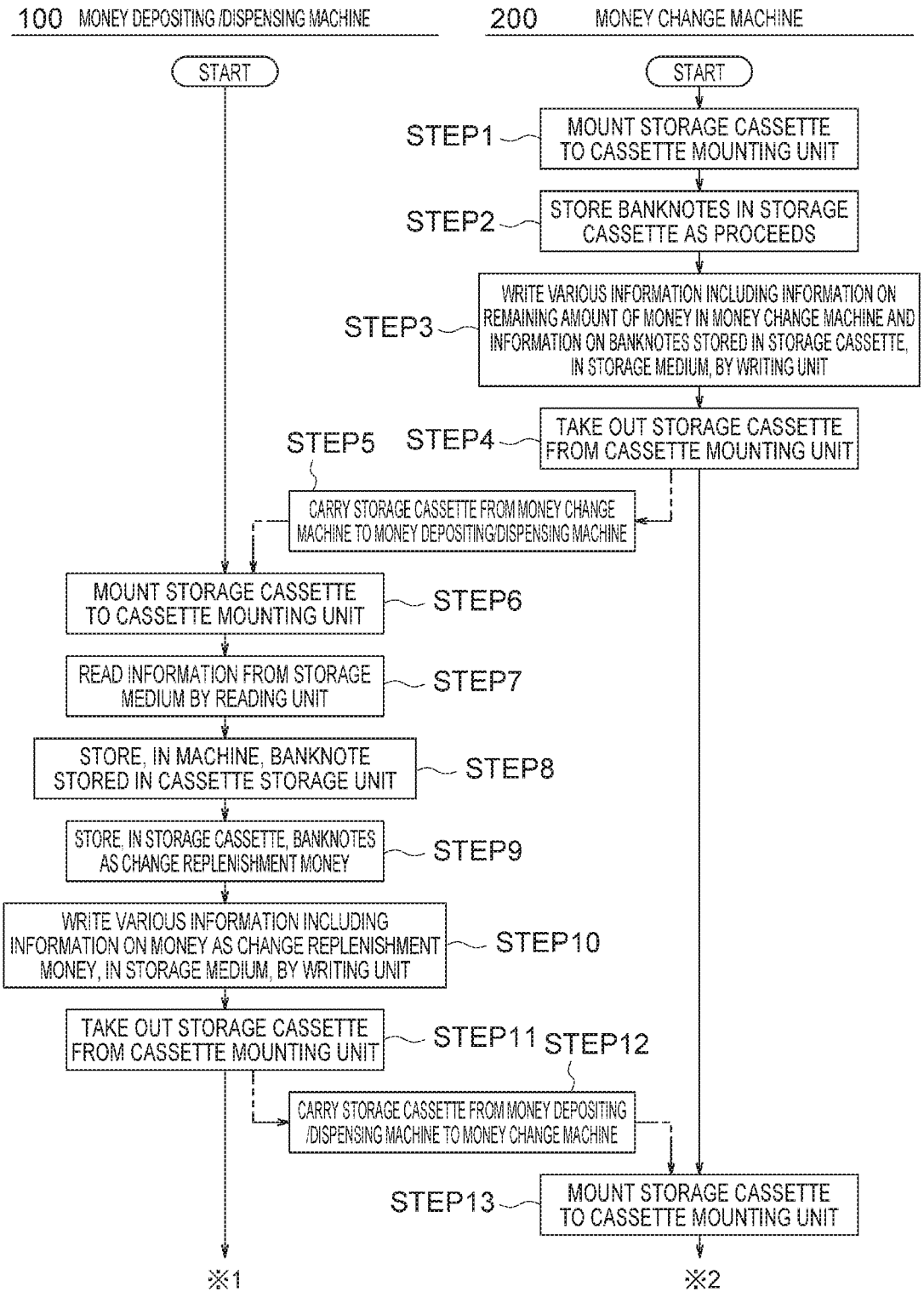
FIG. 13 is a flow chart showing operations performed by the money depositing/dispensing machine and the money change machine, respectively, when the money management system shown in FIG. 1 performs money handling.
Figure 14:
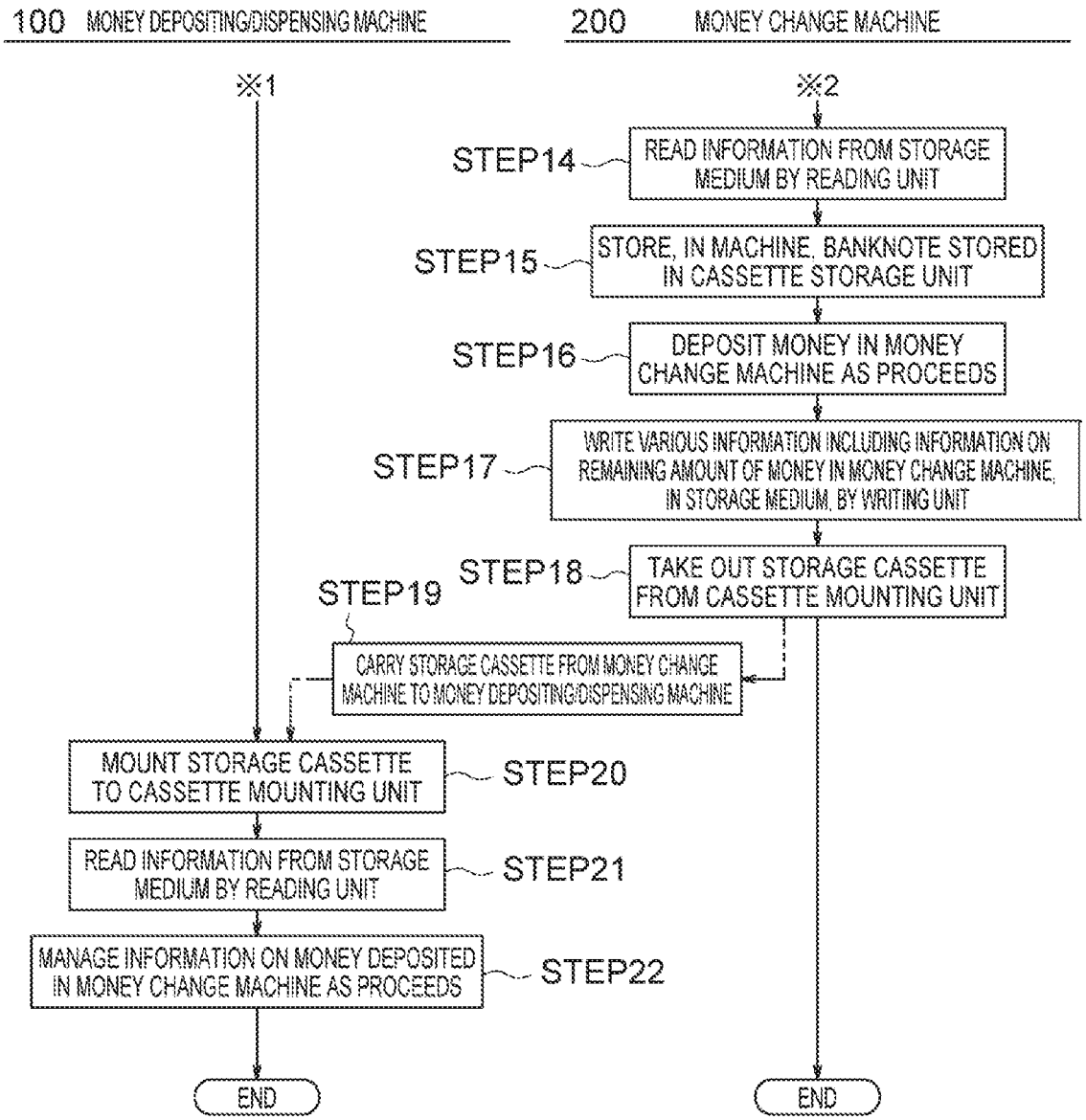
FIG. 14 is a flow chart showing operations performed by the money depositing/dispensing machine and the money change machine, respectively, when the money management system shown in FIG. 1 performs money handling subsequent to the operation shown in the flow chart in FIG. 13.
Figure 15:
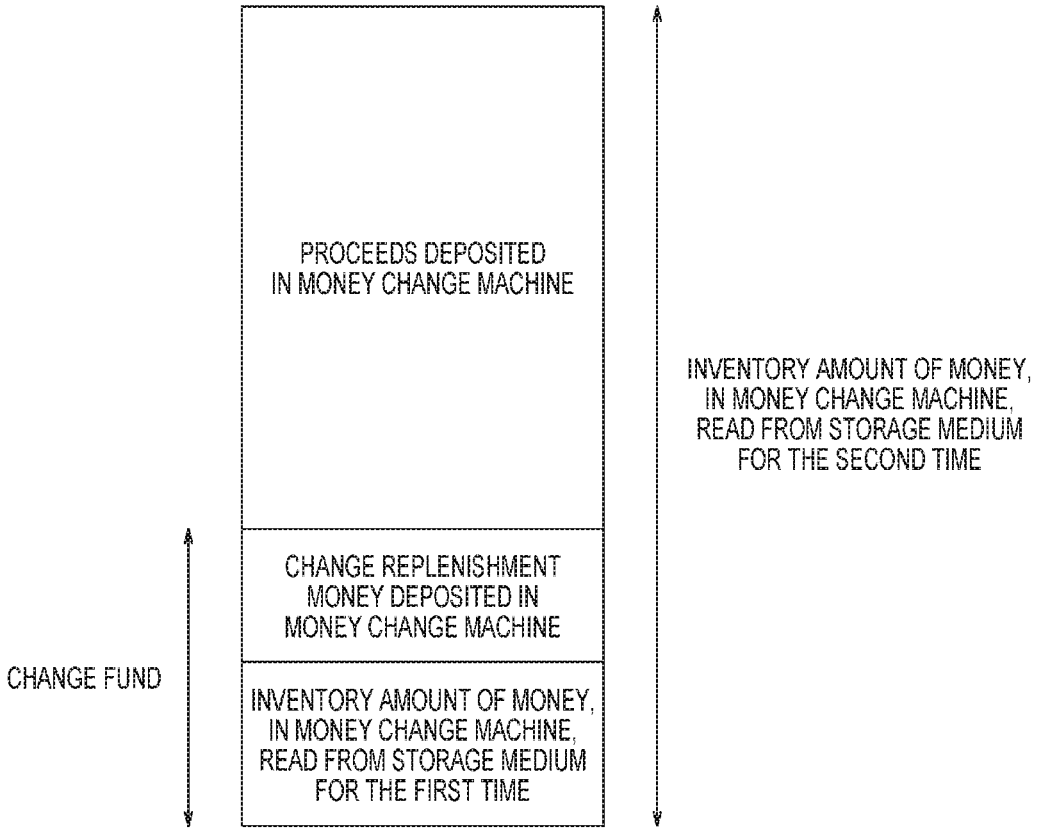
FIG. 15 illustrates information on money deposited in the money change machine as proceeds, which is managed by a proceeds management unit in the money management system shown in FIG. 1.

Hereinafter, an embodiment of the present invention will be described with reference to the drawings. FIG. 1 to FIG. 15 illustrate a money management system according to the present embodiment, and a money change machine as a first money handling apparatus and a money depositing/dispensing machine as a second money handling apparatus, which are disposed in the money management system. Among them, FIG. 1 schematically illustrates a configuration of a money management system according to the present embodiment, and FIG. 2 is a perspective view of an outer appearance of a money depositing/dispensing machine in the money management system shown in FIG. 1. FIG. 3 to FIG. 5 illustrate configurations of a banknote handling assembly, a coin handling assembly, and a coin roll storage assembly, respectively, in the money depositing/dispensing machine shown in FIG. 2. FIG. 6 is a functional block diagram illustrating a configuration of a control system in the money depositing/dispensing machine shown in FIG. 2. FIG. 7 is a perspective view of outer appearances of a money change machine and a POS register in the money management system shown in FIG. 1. FIG. 8 to FIG. 10 illustrate configurations of a banknote handling assembly, a coin handling assembly, and a coin roll storage assembly, respectively, in the money change machine shown in FIG. 7. FIG. 11 is a functional block diagram illustrating a configuration of a control system in the money change machine and the POS register shown in FIG. 7. FIG. 12 is a perspective view of an outer appearance of a storage cassette that is detachably mounted to a cassette mounting unit of the money depositing/dispensing machine and a cassette mounting unit of the money change machine in the money management system shown in FIG. 1. FIG. 13 and FIG. 14 are each a flow chart showing operations performed by the money depositing/dispensing machine and the money change machine, respectively, when the money management system shown in FIG. 1 performs money handling. FIG. 15 illustrates information on money, deposited in the money change machine as proceeds, which is managed by a proceeds management unit in the money management system shown in FIG. 1.

As shown in FIG. 1, in a store 420 in commercial facilities such as a supermarket or a convenience store, store shelves on which various commodities are displayed are installed in a front region which customers are allowed to enter, and, in a settlement place in the front region, a money change machine 200 and a POS (Point of Sales) register 290 are installed. For checkout of a customer at such a settlement place, a clerk performs depositing of money received for the commodity from the customer in the money change machine 200 or performs dispensing of money as change from the money change machine 200 and delivers the change to the customer. Furthermore, information on a commodity purchased by the customer, information on money stored in the money change machine 200, and the like are managed by the POS register 290. Furthermore, in a back office region (specifically, for example, a deposit room) which customers in the store 420 as described above are not allowed to enter, a money depositing/dispensing machine 100 such as a cashier machine that performs depositing of money collected from the money change machine 200 as proceeds is installed. Furthermore, in a case where money as change is insufficient in the money change machine 200, money is dispensed as change replenishment money from the money depositing/dispensing machine 100, and the money change machine 200 can be replenished with the money dispensed as the change replenishment money from the money depositing/dispensing machine 100. In the present embodiment, the money depositing/dispensing machine 100 and the money change machine 200 as described above are combined to structure a money management system 1.

Furthermore, as shown in FIG. 1, in the money management system 1 according to the present embodiment, collection cassettes 140 and 170 (described below) in which banknotes and coins are stored are taken out from the money depositing/dispensing machine 100 by, for example, a guard of a cash in transit company 410, and the banknotes and the coins in the collection cassettes 140 and 170 are collected from the money depositing/dispensing machine 100 by the cash in transit company in a state where the banknotes and the coins are contained in the collection cassettes 140 and 170. Furthermore, the guard of the cash in transit company 410 transports money as a change fund to be used in the money change machine 200 from the cash in transit company 410 to the store 420, and the money is stored in a safe 422 disposed in the store 420. In a case where money as the change fund is insufficient in the money depositing/dispensing machine 100, the guard of the cash in transit company 410 takes out money from the safe 422, to deposit the money in the money depositing/dispensing machine 100.

Furthermore, as shown in FIG. 1, in the money management system 1 of the present embodiment, the money depositing/dispensing machine 100 is connected via a LAN (Local Area Network) 404 to a terminal 400 and a user server 402 disposed outside the store 420 so as to be able to communicate with the terminal 400 and the user server 402, and the terminal 400 and the user server 402 allow information on an inventory amount of money in the money depositing/dispensing machine 100, a guard or the like of the cash in transit company 410, and an operator such as a clerk of the store 420 to be managed.

Next, configurations of the money depositing/dispensing machine 100 and the money change machine 200 of the money management system 1 described above will be described in detail.

Firstly, the configuration of the money depositing/dispensing machine 100 disposed in the back office region in the store 420 will be described in detail with reference to FIG. 2 to FIG. 6. As shown in FIG. 2 and the like, the money depositing/dispensing machine 100 of the present embodiment has a housing 101 shaped in an almost rectangular parallelepiped. Inside the housing 101, a banknote handling assembly 110 that performs depositing and dispensing of banknotes, a coin handling assembly 150 that performs depositing and dispensing of coins, and a coin roll storage assembly 180 that stores a coil roll (a predetermined number (for example, 20 or 50) of coins of the same denomination are collected into a roll and wrapped with a film, a wrapping paper, or the like) are accommodated. As shown in FIG. 2, the banknote handling assembly 110 and the coin handling assembly 150 are aligned in the left-right direction when the money depositing/dispensing machine 100 is viewed from the front side, and the coin roll storage assembly 180 is disposed below the banknote handling assembly 110 and the coin handling assembly 150.

As shown in FIG. 2 and FIG. 3, the banknote handling assembly 110 includes a banknote receptacle unit 120 disposed in the right side region on the front surface side of the housing 101, a banknote dispensing unit 122 disposed below the banknote receptacle unit 120 on the front surface side of the housing 101, a transport unit 130 that transports banknotes one by one in the housing 101, and a plurality of banknote storage units 134 and 136 that stores banknotes in the housing 101 and can feed out the banknotes stored therein. In FIG. 3, the right side surface of the housing 101 corresponds to the surface on the front side of the banknote handling assembly 110, and the leftward direction in FIG. 3 corresponds to the depth direction of the banknote handling assembly 110. As shown in FIG. 3, the transport unit 130 includes a round transport unit 130*a* disposed at the center position in the upper portion of the housing 101, and a plurality of connection transport units 130*b*. Furthermore, the banknote receptacle unit 120, the banknote dispensing unit 122, a dispensing reject unit 124, a cassette mounting unit 126 that allows a storage cassette 300 described below to be detachably mounted, the collection cassette 140, and the two banknote storage units 134 and 136 are disposed so as to surround the round transport unit 130*a*. Furthermore, as shown in FIG. 3, the plurality of connection transport units 130*b* allow connection between the round transport unit 130*a*, and each of the banknote receptacle unit 120, the banknote dispensing unit 122, the dispensing reject unit 124, the cassette mounting unit 126, the collection cassette 140, and the two banknote storage units 134 and 136. Furthermore, a recognition unit 132 is disposed at the round transport unit 130*a*, and the recognition unit 132 performs recognition of a denomination, authentication, fitness/unfitness, face/back, a transport state, and the like for a banknote transported by the round transport unit 130*a*.

The round transport unit 130*a* can transport banknotes one by one in both the clockwise direction and the counterclockwise direction in FIG. 3. Furthermore, in the transport unit 130, a path diverter (not shown) for changing a banknote transport path between the round transport unit 130*a* and each of the connection transport units 130*b* is disposed along the round transport unit 130*a*.

As shown in FIG. 2 and FIG. 3, a banknote receptacle 120*a* of the banknote receptacle unit 120 and a banknote outlet 122*a* of the banknote dispensing unit 122 are disposed on the front surface of the housing 101. Furthermore, a door 126*a* is disposed on the front surface side of the cassette mounting unit 126. By the door 126*a* being opened, the storage cassette 300 can be mounted to the cassette mounting unit 126 or the storage cassette 300 can be taken out from the cassette mounting unit 126. Furthermore, as shown in FIG. 6, the cassette mounting unit 126 includes a writing unit 128 that writes various information in a storage medium 304 (described below) the storage cassette 300 which is mounted to the cassette mounting unit 126, and a reading unit 129 that reads various information from the storage medium 304. The information written in the storage medium 304 by the writing unit 128 and the information read from the storage medium 304 by the reading unit 129 will be described below in detail.

The banknote receptacle unit 120 includes a banknote feeding mechanism 121. When it is detected that one banknote or a plurality of banknotes is inserted in the banknote receptacle 120*a*, the banknote feeding mechanism 121 is driven and the banknotes are thus fed out one by one through the connection transport unit 130*b* toward the round transport unit 130*a*.

The banknote dispensing unit 122 dispenses banknotes fed out from each of the banknote storage units 134, and 136 to the round transport unit 130*a*, to the outside of the housing 101, through the banknote outlet 122*a*.

In the dispensing reject unit 124, a banknote, among the banknotes fed out from each of the banknote storage units 134 and 136 during dispensing, which cannot be recognized by the recognition unit 132 due to abnormality in transporting such as overlapping or skew, is stored as a rejected banknote in dispensing. Furthermore, a banknote, among banknotes taken into the housing 101 from the banknote receptacle unit 120, which cannot be recognized by the recognition unit 132 in depositing due to stain or the like is returned to the banknote dispensing unit 122 as a rejected banknote in depositing.

The banknote storage units 134 and 136 store banknotes for each denomination, based on the recognition result by the recognition unit 132. Banknotes to be dispensed from the money depositing/dispensing machine 100 as change replenishment money for the money change machine 200 are stored in the banknote storage units 134 and 136. Specifically, for example, one thousand yen notes are stored in the banknote storage unit 134, and five thousand yen notes are stored in the banknote storage unit 136. Ten thousand yen notes are stored in the collection cassette 140 described below. Furthermore, the banknote storage units 134 and 136 include banknote feeding mechanisms 135, 137, respectively, and banknotes stored in the banknote storage units 134 and 136 are fed out one by one through the connection transport units 130*b* toward the round transport unit 130*a* by the banknote feeding mechanisms 135, 137, respectively.

In the lower region inside the housing 101, the collection cassette 140 is accommodated, and banknotes to be collected by the cash in transit company 410 are stored in the collection cassette 140. Specifically, a banknote recognized by the recognition unit 132 is transported from the round transport unit 130*a* through the connection transport unit 130*b* to the collection cassette 140. Furthermore, a door 140*a* is disposed on the front surface side of the collection cassette 140. By the door 140*a* being opened, the collection cassette 140 can be accommodated in the housing 101 or the collection cassette 140 can be taken out from the housing 101.

Next, the configuration of the coin handling assembly 150 will be described. As shown in FIG. 2 and FIG. 4, the coin handling assembly 150 includes a coin receptacle unit 152 disposed in the left side region on the front surface side of the housing 101, a coin dispensing unit 166 disposed below the coin receptacle unit 152 on the front surface side of the housing 101, and a plurality of storage/feeding units 160 that stores coins in the housing 101 and can feed out the coins stored therein.

The coin receptacle unit 152 is designed so as to take coins received through a coin inlet, one by one, into the housing 101 in a state where the coins are arranged in one layer in one line. More specifically, the coin receptacle unit 152 includes a coin feeding mechanism 153 (see FIG. 6) implemented by a feed belt or the like. When coins received by the coin receptacle unit 152 are detected, the coin feeding mechanism 153 is driven and the coins are then fed out one by one into the housing 101 by the coin feeding mechanism 153. Furthermore, as shown in FIG. 4, a deposit transport unit 154 for transporting coins fed into the housing 101 by the coin receptacle unit 152 is connected to the coin receptacle unit 152.

As shown in FIG. 4, in the deposit transport unit 154, a recognition unit 156 that performs recognition of a denomination, authentication, fitness/unfitness, face/back, a transport state, and the like for a coin, and a first diverter 158 are disposed. The first diverter 158 is designed so as to diverge a coin such as a rejected coin to be dispensed through the coin dispensing unit 166, from the deposit transport unit 154, on the basis of a coin recognition result by the recognition unit 156, and guide the coin to a dispensing transport unit 162.

Meanwhile, coins, such as normal coins, to be stored in the housing 101 are transported to the storage/feeding units 160 by the deposit transport unit 154. The storage/feeding units 160 are structured so as to be able to store coins for each denomination and feed out the coins stored therein. Specifically, for example, the six storage/feeding units 160 are disposed so as to correspond to six denominations (500 yen coin, 100 yen coin, 50 yen coin, 10 yen coin, 5 yen coin, and 1 yen coin) of coins that circulate in Japan. Coins are stored for each denomination in the storage/feeding units 160 from the uppermost-stream side (that is, the lowermost side in FIG. 4) of the deposit transport unit 154 in order starting from the smallest denomination coin. Furthermore, each storage/feeding unit 160 includes a coin feeding mechanism (not shown) that feeds out coins stored in the storage/feeding unit 160 one by one to the dispensing transport unit 162.

The dispensing transport unit 162 is designed so as to transport the coins fed out from the storage/feeding units 160, to the coin dispensing unit 166. Furthermore, in the dispensing transport unit 162, for example, a rejected coin diverged from the deposit transport unit 154 by the first diverter 158 is transported to the coin dispensing unit 166.

In the lower region in the housing 101, the collection cassette 170 is accommodated, and coins to be collected by the cash in transit company 410 are stored in the collection cassette 170. Specifically, as shown in FIG. 4, a second diverter 164 is disposed at the dispensing transport unit 162, and a coin diverged from the dispensing transport unit 162 by the second diverter 164 is transported to the collection cassette 170, and stored in the collection cassette 170. Furthermore, on the front surface side of the collection cassette 170, a door 170*a* is disposed. By the door 170*a* being opened, the collection cassette 170 can be accommodated in the housing 101 or the collection cassette 170 can be taken out from the housing 101.

Next, the configuration of the coin roll storage assembly 180 will be described. As shown in FIG. 5, the coin roll storage assembly 180 includes a drawer unit 182 having a plurality of the storage regions 180*a* to 180*f* in which coin rolls are stored for each denomination, and the drawer unit 182 can be drawn forward from the housing 101 of the money depositing/dispensing machine 100. As shown in FIG. 5, when coin rolls are stored in the storage regions 180*a* to 180*f*, the long edge direction of the coin rolls is oriented in the vertical direction. By the drawer unit 182 being drawn forward from the housing 101 of the money depositing/dispensing machine 100, coin rolls can be stored in the storage regions 180*a* to 180*f*, or coin rolls stored in the storage regions 180*a* to 180*f* can be taken out. Furthermore, as shown in FIG. 6, the coin roll storage assembly 180 has a locking mechanism 184 for locking the drawer unit 182 into the housing 101. In a state where the drawer unit 182 is locked in the housing 101, the drawer unit 182 cannot be drawn forward from the housing 101. Furthermore, the coin roll storage assembly 180 includes a weight measurement unit 186 for measuring the weight of coin rolls stored in the respective storage regions 180*a* to 180*f* of the drawer unit 182. The number of coin rolls stored in each of the storage regions 180*a* to 180*f* of the drawer unit 182 is detected by a control unit 102 described below, on the basis of the weight of the coin rolls measured by the weight measurement unit 186.

In order to detect the number of coin rolls stored in each of the storage regions 180*a* to 180*f*, the number of coin rolls stored in each of the storage regions 180*a* to 180*f* may be detected by using a line sensor or a magnetic sensor instead of the weight of the coin rolls being measured by the weight measurement unit 186 or in addition to the weight of the coin rolls being measured by the weight measurement unit 186. Alternatively, by using the line sensor and the magnetic sensor in combination, the number of coin rolls stored in each of the storage regions 180*a* to 180*f* may be detected. Furthermore, each of the storage regions 180*a* to 180*f* may have a line sensor or a magnetic sensor.

Furthermore, in the example shown in FIG. 5, each of the storage regions 180*a* to 180*f* is sectioned into a plurality of regions, and 10 coin rolls are stored in each section. However, the present invention is not limited to such an example. Five coin rolls may be stored in each section. Alternatively, three coin rolls may be stored in each section. Furthermore, a plurality of kinds of sections may be used in combination so as to store the different numbers of coin rolls. Furthermore, although an exemplary case where the number of the coin roll storage assemblies 180 disposed is one, has been described above, the present invention is not limited to such an example. A plurality of the coin roll storage assemblies 180 may be disposed. In this case, a plurality of the coin roll storage assemblies 180 may be disposed so as to correspond to the denominations, respectively, of the coin rolls. Alternatively, for example, coin rolls of a plurality of denominations may be stored in each of two coin roll storage assemblies 180.

Next, the configuration of a control system of the money depositing/dispensing machine 100 as described above will be described with reference to FIG. 6. As shown in FIG. 6, the control unit 102 is disposed in the housing 101 of the money depositing/dispensing machine 100 according to the present embodiment, and the control unit 102 controls components of the banknote handling assembly 110, the coin handling assembly 150, and the coin roll storage assembly 180. Specifically, the banknote feeding mechanism 121, the transport unit 130, the recognition unit 132, the banknote feeding mechanisms 135 and 137, the cassette mounting unit 126, the writing unit 128, the reading unit 129, and the like of the banknote handling assembly 110 are connected to the control unit 102. Banknote recognition information by the recognition unit 132, and information read by the reading unit 129 from the storage medium 304 disposed at the storage cassette 300 are transmitted to the control unit 102, and the control unit 102 controls the components by transmitting an instruction signal to each of the components of the banknote handling assembly 110. Furthermore, the coin feeding mechanism 153, the deposit transport unit 154, the recognition unit 156, the first diverter 158, the storage/feeding units 160, the dispensing transport unit 162, the second diverter 164, and the like of the coin handling assembly 150 are connected to the control unit 102. Coin recognition information by the recognition unit 156 is transmitted to the control unit 102, and the control unit 102 controls the components by transmitting an instruction signal to each of the components of the coin handling assembly 150. Furthermore, the locking mechanism 184, the weight measurement unit 186, and the like of the coin roll storage assembly 180 are connected to the control unit 102, and the result of measurement of coin rolls by the weight measurement unit 186 is transmitted to the control unit 102, and the control unit 102 controls the locking mechanism 184 by transmitting an instruction signal to the locking mechanism 184.

Furthermore, as shown in FIG. 6, an operation/display unit 104, a communication unit 105, a memory unit 106, an inventory amount management unit 107, a calculation unit 108, and a proceeds management unit 109 are connected to the control unit 102. The operation/display unit 104 is implemented by a touch panel or the like disposed at an upper portion of the housing 101. An operation screen operated by an operator, and information on an inventory amount of money stored in each of the banknote handling assembly 110, the coin handling assembly 150, and the coin roll storage assembly 180 are displayed on the operation/display unit 104. Furthermore, the operation/display unit 104 described above allows an operator to touch an operation button on the operation screen with her/his finger, thereby inputting various instructions to the control unit 102. The communication unit 105 can transmit various signals to and receive various signals from the terminal 400 and the user server 402 via the LAN 404. Information on an inventory amount of money stored in each of the banknote handling assembly 110, the coin handling assembly 150, and the coin roll storage assembly 180, and various information such as a money handling history in the money depositing/dispensing machine 100 are stored in the memory unit 106. Furthermore, in the present embodiment, information on an amount of money set to be left for each denomination in the money change machine 200 as a change fund is also stored in the memory unit 106. The amount of money set to be left for each denomination in the money change machine 200 as a change fund represents, for example, an amount of money for each denomination to be stored in the money change machine 200 as the change fund at the start of business hours in the store 420.

Furthermore, in the present embodiment, information on an inventory amount of money in the money change machine 200 is written in the storage medium 304 disposed at the storage cassette 300 in the money change machine 200, and the inventory amount management unit 107 manages the inventory amount of money being in the money change machine 200 on the basis of the information read from the storage medium 304 of the storage cassette 300 by the reading unit 129. Furthermore, the calculation unit 108 calculates an amount of money for each denomination as change replenishment money to be deposited in the money change machine 200 on the basis of the inventory amount of money being in the money change machine 200 and managed by the inventory amount management unit 107, and the information stored in the memory unit 106. Furthermore, the proceeds management unit 109 manages information on money deposited in the money change machine 200 as proceeds, on the basis of information, on an inventory amount of money in the money change machine 200, read from the storage medium 304 of the storage cassette 300 by the reading unit 129, and information on change replenishment money written in the storage medium 304 by the writing unit 128. Functions of the inventory amount management unit 107, the calculation unit 108, and the proceeds management unit 109 will be described below in detail.

In the money depositing/dispensing machine 100 according to modification, instead of the inventory amount management unit 107, a change replenishment money management unit 107*a* that manages an amount of money for each denomination as the change replenishment money to be deposited in the money depositing/dispensing machine 100 may be disposed. The configuration of the money depositing/dispensing machine 100 according to this modification will be described below in detail.

Next, the configuration of the money change machine 200 disposed in the front region of the store 420 will be described in detail with reference to FIG. 7 to FIG. 11. As shown in FIG. 7 and the like, the money change machine 200 according to the present embodiment has a coin handling assembly 250 and a coin roll storage assembly 280 aligned in the up-down direction, and a banknote handling assembly 210 that is aligned with and adjacent to the coin handling assembly 250 and the coin roll storage assembly 280. The POS register 290 is placed on the banknote handling assembly 210 and the coin handling assembly 250. The banknote handling assembly 210 and the coin handling assembly 250 perform depositing and dispensing of banknotes and coins, respectively. Furthermore, the coin roll storage assembly 280 stores coin rolls of each denomination such that the coin rolls can be taken out. Furthermore, the POS register 290 is used as a management device for managing the money change machine 200.

Firstly, the configuration of the banknote handling assembly 210 will be specifically described with reference to FIG. 7 and FIG. 8. As shown in FIG. 7 and FIG. 8, the banknote handling assembly 210 has a housing 212 shaped in an almost rectangular parallelepiped, a banknote receptacle unit 220 disposed on the front surface side of the housing 212, a banknote dispensing unit 222 disposed below the banknote receptacle unit 220 on the front surface side of the housing 212, a transport unit 230 that transports banknotes one by one in the housing 212, and a plurality of banknote storage units 234, 236, and 238 that stores banknotes in the housing 212 and can feed out the banknotes stored therein. In FIG. 8, the right side surface of the housing 212 corresponds to the surface on the front side of the banknote handling assembly 210, and the leftward direction in FIG. 8 corresponds to the depth direction of the banknote handling assembly 210. As shown in FIG. 8, the transport unit 230 includes a round transport unit 230*a* disposed at the center position of the housing 212, and a plurality of connection transport units 230*b*. Furthermore, the banknote receptacle unit 220, the banknote dispensing unit 222, a dispensing reject unit 224, a cassette mounting unit 226 that allows the storage cassette 300 described below to be detachably mounted, and the three banknote storage units 234, 236, and 238 are disposed so as to surround the round transport unit 230*a*. Furthermore, as shown in FIG. 8, the plurality of connection transport units 230*b* allow connection between the round transport unit 230*a*, and each of the banknote receptacle unit 220, the banknote dispensing unit 222, the dispensing reject unit 224, the cassette mounting unit 226, and the three banknote storage units 234, 236, and 238. Furthermore, a recognition unit 232 is disposed at the round transport unit 230*a*, and the recognition unit 232 performs recognition of a denomination, authentication, fitness/unfitness, face/back, a transport state, and the like for a banknote transported by the round transport unit 230*a*.

The round transport unit 230*a* can transport banknotes one by one in both the clockwise direction and the counterclockwise direction in FIG. 8. Furthermore, in the transport unit 230, a path diverter (not shown) for changing a banknote transport path between the round transport unit 230*a* and each of the connection transport units 230*b* is disposed along the round transport unit 230*a*.

As shown in FIG. 7 and FIG. 8, a banknote receptacle 220*a* of the banknote receptacle unit 220 and a banknote outlet 222*a* of the banknote dispensing unit 222 are disposed on the front surface of the housing 212. Furthermore, a door 226*a* is disposed on the front surface side of the cassette mounting unit 226. By the door 226*a* being opened, the storage cassette 300 can be mounted to the cassette mounting unit 226 or the storage cassette 300 can be taken out from the cassette mounting unit 226. Furthermore, as shown in FIG. 11, the cassette mounting unit 226 includes a writing unit 228 that writes various information in the storage medium 304 (described below) disposed at the storage cassette 300 which is mounted to the cassette mounting unit 226, and a reading unit 229 that reads various information from the storage medium 304. The information written in the storage medium 304 by the writing unit 228, and the information read from the storage medium 304 by the reading unit 229 will be described below in detail.

The banknote receptacle unit 220 includes a banknote feeding mechanism 221. When it is detected that one banknote or a plurality of banknotes is inserted in the banknote receptacle 220*a*, the banknote feeding mechanism 221 is driven, and the banknotes are thus fed out one by one through the connection transport unit 230*b* toward the round transport unit 2308.

The banknote dispensing unit 222 dispenses banknotes fed out from each of the banknote storage units 234, 236, and 238 to the round transport unit 230*a*, to the outside of the housing 212, through the banknote outlet 222*a*.

In the dispensing reject unit 224, a banknote, among the banknotes fed out from each of the banknote storage units 234, 236, and 238 during dispensing, which cannot be recognized by the recognition unit 232 due to abnormality in transporting such as overlapping or skew, is stored as a rejected banknote in dispensing. Furthermore, a banknote, among banknotes taken into the housing 212 from the banknote receptacle unit 220, which cannot be recognized by the recognition unit 232 in depositing due to stain or the like is returned to the banknote dispensing unit 222 as a rejected banknote in depositing.

The banknote storage units 234, 236, and 238 store banknotes for each denomination, based on the recognition result by the recognition unit 232. In the banknote storage units 234, 236, and 238, banknotes deposited in the banknote handling assembly 210 as proceeds, and banknotes to be dispensed as change, are stored. Specifically, for example, one thousand yen notes are stored in the banknote storage unit 234, two-thousand yen notes and five thousand yen notes are stored in the banknote storage unit 236 in a mixed state, and ten thousand yen notes are stored in the banknote storage unit 238. Furthermore, the banknote storage units 234, 236, and 238 include banknote feeding mechanisms 235, 237, and 239, respectively, and banknotes stored in the banknote storage units 234, 236, and 238 are fed out one by one through the connection transport units 230*b* toward the round transport unit 230*a* by the banknote feeding mechanisms 235, 237, and 239, respectively.

Next, the configuration of the coin handling assembly 250 will be described. As shown in FIG. 7 and FIG. 9, the coin handling assembly 250 includes a housing 251 shaped in an almost rectangular parallelepiped, a coin receptacle unit 252 disposed on the front surface side of the housing 251, a coin dispensing unit 266 disposed below the coin receptacle unit 252 on the front surface side of the housing 251, and a plurality of storage/feeding units 260 that stores coins in the housing 251 and can feed out the coins stored therein.

The coin receptacle unit 252 is designed so as to take coins received through a coin inlet, one by one, into the housing 251 in a state where the coins are arranged in one layer in one line. More specifically, the coin receptacle unit 252 includes a coin feeding mechanism 253 (see FIG. 11) implemented by a feed belt or the like. When coins received by the coin receptacle unit 252 are detected, the coin feeding mechanism 253 is driven and the coins are then fed out one by one into the housing 251 by the coin feeding mechanism 253. Furthermore, as shown in FIG. 9, a deposit transport unit 254 for transporting coins fed into the housing 251 by the coin receptacle unit 252 is connected to the coin receptacle unit 252.

As shown in FIG. 9, in the deposit transport unit 254, a recognition unit 256 that performs recognition of a denomination, authentication, fitness/unfitness, face/back, a transport state, and the like for a coin, and a diverter 258 are disposed. The diverter 258 is designed so as to diverge a coin such as a rejected coin to be dispensed through the coin dispensing unit 266, from the deposit transport unit 254, on the basis of a coin recognition result by the recognition unit 256, and guide the coin to the dispensing transport unit 262.

Meanwhile, coins, such as normal coins, to be stored in the housing 251 are transported to the storage/feeding units 260 by the deposit transport unit 254. The storage/feeding units 260 are structured so as to be able to store coins for each denomination and feed out the coins stored therein. Specifically, for example, the six storage/feeding units 260 are disposed so as to correspond to six denominations (500 yen coin, 100 yen coin, 50 yen coin, 10 yen coin, 5 yen coin, and 1 yen coin) of coins that circulate in Japan. Coins are stored for each denomination in the storage/feeding units 260 from the uppermost-stream side (that is, the lowermost side in FIG. 9) of the deposit transport unit 254 in order starting from the smallest denomination coin. Furthermore, each storage/feeding unit 260 includes a coin feeding mechanism (not shown) that feeds out coins stored in the storage/feeding unit 260 one by one to the dispensing transport unit 262.

The dispensing transport unit 262 is designed so as to transport the coins fed out from the storage/feeding units 260, to the coin dispensing unit 266. Furthermore, in the dispensing transport unit 262, for example, a rejected coin diverged from the deposit transport unit 254 by the diverter 258 is transported to the coin dispensing unit 266.

Next, the configuration of the coin roll storage assembly 280 will be specifically described. As shown in FIG. 7 and FIG. 10, the coin roll storage assembly 280 includes a housing 281 that is shaped in an almost rectangular parallelepiped and is opened on the side surface on the front surface side, and a storage drawer 282 that can be accommodated in the housing 281 and can be drawn forward from the housing 281. In the storage drawer 282, coin rolls of each denomination are stored in, for example, two rows (in FIG. 10, coin rolls, of each denomination, stored in the storage drawer 282 are represented by diagonal lines). The storage drawer 282 has a plurality of storage portions (pockets) each of which stores one coin roll, and the number and positions of coin rolls, for each denomination, to be stored in the storage portions are preset. Specifically, in FIG. 10, eight 100-yen coin rolls can be stored in a region indicated by reference character A, one 500-yen coin roll can be stored in a region indicated by reference character B, and one 50-yen coin roll can be stored in a region indicated by reference character C. Furthermore, in FIG. 10, six 10-yen coin rolls can be stored in a region indicated by reference character D, four 1-yen coin rolls can be stored in a region indicated by the reference character E, and one 5-yen coin roll can be stored in a region indicated by the reference character F.

Furthermore, as shown in FIG. 11, a locking mechanism 286 for locking the storage drawer 282 into the housing 281 when the storage drawer 282 has been completely accommodated in the housing 281 is disposed in the housing 281 of the coin roll storage assembly 280. When the storage drawer 282 has been locked in the housing 281 by the locking mechanism 286, the storage drawer 282 cannot be drawn forward from the housing 281. Therefore, the coin rolls cannot be taken out from the storage drawer 282.

Furthermore, near an opening in the front surface of the housing 281 of the coin roll storage assembly 280, a detection unit 284 is disposed which detects, for each denomination, the number of coin rolls stored in the storage drawer 282 when the storage drawer 282 is drawn forward from the housing 281 and returned into the housing 281. Specifically, as shown in FIG. 10 and the like, the detection unit 284 has a pair of left and right optical sensors 284*a*, and a rotary encoder 284*b* that detects a distance over which the storage drawer 282 is drawn from the housing 281. Each of the optical sensors 284*a* has a light emitting element and a light receiving element, and light emitted from the light emitting element is transmitted to the light receiving element through an optical axis that extends in the width direction (in the left-right direction in FIG. 10) of the coin roll storage assembly 280. When the storage drawer 282 has been completely accommodated in the housing 281, or when the storage drawer 282 has been completely drawn from the housing 281, light emitted from the light emitting element is received by the light receiving element in each of the optical sensors 284*a*. Meanwhile, when the storage drawer 282 is being drawn forward from the housing 281, or when the storage drawer 282 is being returned into the housing 281, light emitted from the light emitting element is blocked by the coin rolls stored in the storage drawer 282 and does not reach the light receiving element, whereby presence or absence of a hole in the coin rolls and the size of the diameter of the coin rolls can be detected. As described above, in the storage drawer 282, the number and positions of the coin rolls, for each denomination, to be stored are preset. Therefore, for example, the number of coin rolls, for each denomination, stored in the storage drawer 282, and whether or not each coin roll is correctly stored at a predetermined position in the storage drawer 282 are detected based on presence or absence of a hole in the coin rolls and the size of the diameter of the coin rolls, which are detected by the optical sensor 284*a*, and a distance, detected by the rotary encoder 284*b*, over which the storage drawer 282 has been drawn from the housing 281.

The coin roll storage assembly 280 according to the present embodiment is not limited to the above-described configuration. In a coin roll storage assembly 280 having another configuration, a sensor for detecting presence or absence and a denomination (material) of coin rolls stored in a storage portion of the storage drawer 282 may be disposed in each of the storage portions, as the detection unit 284 that detects the number of coin rolls, for each denomination, stored in the storage drawer 282.

Next, the configuration of the POS register 290 will be specifically described. As shown in FIG. 7 and FIG. 11, the POS register 290 includes a POS control unit 291, and a display unit 293 such as a monitor and an operation unit 294 such as an operation key. The display unit 293 and the operation unit 294 are connected to the POS control unit 291. An operator is allowed to operate the operation unit 294, thereby providing the POS control unit 291 with various instructions. Furthermore, the display unit 293 displays information representing, for example, handling states of handling banknotes and coins in the banknote handling assembly 210 and the coin handling assembly 250, and inventory amounts of banknotes and coins stored in the banknote handling assembly 210 and the coin handling assembly 250. Furthermore, the POS register 290 has an additional display unit 293*a* which can be viewed by a customer, and various information may be displayed on the additional display unit 293*a* instead of various information being displayed on the display unit 293 or in addition to various information being displayed on the display unit 293. Furthermore, the POS register 290 has a card reader 296 and a printing unit 297 (see FIG. 11, not shown in FIG. 7). The card reader 296 reads an ID card carried by an operator such as a clerk, and then obtains information on the ID, the authority, or the like of the operator. Furthermore, the printing unit 297 is implemented by, for example, a printer, and prints, on a receipt, information such as the inventory amounts of banknotes and coins stored in the banknote handling assembly 210 and the coin handling assembly 250, in addition to a sales receipt and summing receipt.

Next, the configuration of a control system of the money change machine 200 as described above will be described with reference to FIG. 11. As shown in FIG. 11, the coin handling assembly 250 has a higher-ranking control unit 202 and a coin control unit 250*a*. The higher-ranking control unit 202 and the coin control unit 250*a* are connected to each other. Furthermore, the banknote handling assembly 210 has a banknote control unit 210*a*, and the banknote control unit 210*a* is connected to the higher-ranking control unit 202 of the coin handling assembly 250. Furthermore, the coin roll storage assembly 280 has a coin roll control unit 280*a*, and the coin roll control unit 280*a* is connected to the higher-ranking control unit 202 of the coin handling assembly 250. Furthermore, the POS control unit 291 disposed in the POS register 290 is also connected to the higher-ranking control unit 202 of the coin handling assembly 250. Furthermore, the POS control unit 291 of the POS register 290 is connected to a higher-ranking terminal such as a store server so as to be able to communicate with the higher-ranking terminal, which is not shown.

As shown in FIG. 11, a communication unit 203 for communication with each of the banknote handling assembly 210, the coin roll storage assembly 280, and the POS register 290, an operation/display unit 204, a comparison unit 205, a dispensed money information management unit 206, a memory unit 208, and a determination unit 209 are connected to the higher-ranking control unit 202 of the coin handling assembly 250. The higher-ranking control unit 202 transmits signals to and receives signals from the banknote control unit 210*a* of the banknote handling assembly 210, the coin roll control unit 280*a* of the coin roll storage assembly 280, and the POS control unit 291 of the POS register 290 through the communication unit 203. Furthermore, the operation/display unit 204 is implemented by, for example, a touch panel disposed on the upper surface of the housing 251 of the coin handling assembly 250, and an operation screen operated by an operator, and information on an inventory amount of money stored in each of the banknote handling assembly 210, the coin handling assembly 250, and the coin roll storage assembly 280 are displayed on the operation/display unit 204. The operation/display unit 204 described above allows an operator to touch an operation button on the operation screen with his/her finger, and thus input various instructions to the higher-ranking control unit 202. In the memory unit 208, various information such as information on an inventory amount of money stored in each of the banknote handling assembly 210, the coin handling assembly 250, and the coin roll storage assembly 280, and a money handling history in the money change machine 200, is stored. Furthermore, the comparison unit 205 performs comparison between an amount of money for each denomination deposited in the money change machine 200 as change replenishment money, and an amount of money for each denomination as change replenishment money based on information read by the reading unit 229 from the storage medium 304 disposed at the storage cassette 300. Furthermore, the dispensed money information management unit 206 manages information (in particular, information on coin rolls) on money dispensed from the money depositing/dispensing machine 100, based on information read by the reading unit 229 from the storage medium 304 disposed at the storage cassette 300. Furthermore, the determination unit 209 determines whether or not the number of coin rolls for each denomination deposited in the storage drawer 282 of the coin roll storage assembly 280 coincides with the number of coin rolls for each denomination dispensed from the money depositing/dispensing machine 100. In this case, the number of coin rolls for each denomination deposited in the storage drawer 282 of the coin roll storage assembly 280 has been detected by the detection unit 284, and the number of coin rolls for each denomination dispensed from the money depositing/dispensing machine 100 has been read by the reading unit 229 from the storage medium 304 disposed at the storage cassette 300. The functions of the comparison unit 205, the dispensed money information management unit 206, and the determination unit 209 will be described below in detail.

Furthermore, a communication unit 240, the banknote feeding mechanism 221, the transport unit 230, the recognition unit 232, the banknote feeding mechanisms 235, 237, and 239, the cassette mounting unit 226, the writing unit 228, the reading unit 229, and the like are connected to the banknote control unit 210*a* of the banknote handling assembly 210. Banknote recognition information by the recognition unit 232, and information read by the reading unit 229 from the storage medium 304 disposed at the storage cassette 300 are transmitted to the banknote control unit 210*a*, and the banknote control unit 210*a* transmits instruction signals to the components of the banknote handling assembly 210, thereby controlling the components. Furthermore, the banknote control unit 210*a* uses the communication unit 240 to transmit a signal to and receive a signal from the higher-ranking control unit 202 of the coin handling assembly 250.

Furthermore, the coin feeding mechanism 253, the deposit transport unit 254, the recognition unit 256, the diverter 258, each storage/feeding unit 260, the dispensing transport unit 262, and the like are connected to the coin control unit 250*a* of the coin handling assembly 250. Coin recognition information by the recognition unit 256 is transmitted to the coin control unit 250*a*, and the coin control unit 250*a* transmits instruction signals to the components of the coin handling assembly 250, thereby controlling the components thereof.

Furthermore, a communication unit 289, the detection unit 284, the locking mechanism 286, a memory unit 288, and the like are connected to the coin roll control unit 280*a* of the coin roll storage assembly 280. Detection information for coin rolls by the detection unit 284 is transmitted to the coin roll control unit 280*a*, and the coin roll control unit 280*a* transmits an instruction signal to the locking mechanism 286, thereby controlling the locking mechanism 286. Furthermore, the coin roll control unit 280*a* uses the communication unit 289 to transmit a signal to and receive a signal from the higher-ranking control unit 202 of the coin handling assembly 250. Furthermore, for example, information on an inventory amount of coin rolls stored in the storage drawer 282 of the coin roll storage assembly 280 is stored in the memory unit 288.

Furthermore, the display unit 293, the operation unit 294, a memory unit 295, a communication unit 292, the card reader 296, the printing unit 297, and the like are connected to the POS control unit 291 of the POS register 290 so as to be able to communicate with the POS control unit 291. An instruction inputted to the operation unit 294 by an operator is transmitted from the operation unit 294 to the POS control unit 291, and information, on an ID card of an operator such as a clerk, which is read by the card reader 296 is transmitted to the POS control unit 291. Furthermore, the POS control unit 291 causes the display unit 293 to display various information by transmitting an instruction to the display unit 293. The POS control unit 291 may cause the additional display unit 293*a* to display various information instead of causing the display unit 293 to display various information or in addition to causing the display unit 293 to display various information. Furthermore, the POS control unit 291 causes the printing unit 297 to print various information on a receipt or the like by transmitting an instruction to the printing unit 297. Furthermore, the POS control unit 291 of the POS register 290 uses the communication unit 292 to transmit a signal to and receive a signal from a higher-ranking terminal (not shown) such as a store server, and the higher-ranking control unit 202 of the coin handling assembly 250. Furthermore, various information such as coin and banknote handling states, in the banknote handling assembly 210 and the coin handling assembly 250, which are transmitted from, for example, the banknote handling assembly 210 and the coin handling assembly 250, and inventory amounts of banknotes, coins, and coin rolls stored in the banknote handling assembly 210, the coin handling assembly 250, and the coin roll storage assembly 280, is stored in the memory unit 295.

Next, the configuration of the storage cassette 300 for exchanging banknotes between the money depositing/dispensing machine 100 and the money change machine 200 will be described with reference to FIG. 12. As shown in FIG. 12, the storage cassette 300 has a casing 301 shaped in an almost rectangular parallelepiped, and banknotes are stored in the casing 301 in a stacked state. Furthermore, as described above, the storage cassette 300 is capable to be detachably mounted to the cassette mounting unit 126 of the money depositing/dispensing machine 100 and the cassette mounting unit 226 of the money change machine 200. Furthermore, an opening 302 is formed in the side surface of the casing 301 of the storage cassette 300. When the storage cassette 300 is mounted to the cassette mounting unit 126 of the money depositing/dispensing machine 100 or the cassette mounting unit 226 of the money change machine 200, banknotes are transported through the opening 302 into the storage cassette 300 by the transport unit 130 disposed at the banknote handling assembly 110 of the money depositing/dispensing machine 100 or the transport unit 230 disposed at the banknote handling assembly 210 of the money change machine 200, and banknotes stored in the storage cassette 300 are fed out through the opening 302 to the transport unit 130 of the banknote handling assembly 110 of the money depositing/dispensing machine 100 or the transport unit 230 of the banknote handling assembly 210 of the money change machine 200.

More specifically, a banknote feeding mechanism that feeds out banknotes stored in the storage cassette 300, through the opening 302, to the outside of the casing 301 is disposed in the storage cassette 300. Furthermore, when the storage cassette 300 is mounted to the cassette mounting unit 126 of the money depositing/dispensing machine 100 or the cassette mounting unit 226 of the money change machine 200, power is transmitted to the banknote feeding mechanism of the storage cassette 300 from the banknote handling assembly 110 of the money depositing/dispensing machine 100 or the banknote handling assembly 210 of the money change machine 200. Thus, in a state where the storage cassette 300 is taken out from the cassette mounting unit 126 of the money depositing/dispensing machine 100 or the cassette mounting unit 226 of the money change machine 200, banknotes stored in the storage cassette 300 cannot be fed out to the outside of the casing 301. Therefore, security for banknotes stored in the storage cassette 300 can be enhanced.

Furthermore, the storage medium 304 such as an IC chip is disposed on the side surface of the casing 301 of the storage cassette 300. When the storage cassette 300 is mounted to the cassette mounting unit 126 of the money depositing/dispensing machine 100 or the cassette mounting unit 226 of the money change machine 200, various information can be written and memorized in the storage medium 304 by the writing unit 128 disposed at the cassette mounting unit 126 of the money depositing/dispensing machine 100 or the writing unit 228 disposed at the cassette mounting unit 226 of the money change machine 200, or various information memorized in the storage medium 304 can be read from the storage medium 304 by the reading unit 129 disposed at the cassette mounting unit 126 of the money depositing/dispensing machine 100 or the reading unit 229 disposed at the cassette mounting unit 226 of the money change machine 200.

Next, an operation performed by the money management system 1 having such a configuration will be described. Specifically, an operation of collecting money from the money change machine 200 as proceeds of the store 420 and storing the money in the money depositing/dispensing machine 100, and then storing money, as change replenishment money dispensed from the money depositing/dispensing machine 100, in the money change machine 200, will be described with reference to flow charts shown in FIG. 13 and FIG. 14.

When money is collected from the money change machine 200 as proceeds of the store 420, and stored in the money depositing/dispensing machine 100, an operator such as a clerk firstly mounts the storage cassette 300 to the cassette mounting unit 226 disposed in the banknote handling assembly 210 of the money change machine 200 (STEP1). The banknotes are stored in the storage cassette 300 as the proceeds of the store 420 (STEP2). Specifically, among banknotes stored in the banknote storage units 234, 236, and 238, banknotes which are other than banknotes to be left as change in the banknote storage units 234, 238, and 238 (that is, which are other than banknotes to be left as a change fund), are fed out to the transport unit 230 from the banknote storage units 234, 236, and 238 by the banknote feeding mechanisms 235, 237, and 239, respectively, and transported to the storage cassette 300 mounted to the cassette mounting unit 226 by the transport unit 230. Furthermore, when the banknotes are stored in the storage cassette 300 as the proceeds of the store 420, the writing unit 228 writes, in the storage medium 304, various information including information on an inventory amount of money in the money change machine 200, and information on the banknotes stored in the storage cassette 300, and the storage medium memorizes the various information (STEP3). At this time, although only banknotes are stored in the storage cassette 300, information on an inventory amount of banknotes for each denomination in the banknote handling assembly 210, an inventory amount of coins for each denomination in the coin handling assembly 250, and an inventory amount of coin rolls for each denomination in the coin roll storage assembly 280 is written in the storage medium 304 by the writing unit 228. Furthermore, at this time, a register number of a register at which the money change machine 200 is set is also written in the storage medium 304 by the writing unit 228. Furthermore, information on a state of the money change machine 200 is also written in the storage medium 304 by the writing unit 228. Specifically, in a case where an error occurs in the money change machine 200, error information such as a kind of the error in the money change machine 200 is written in the storage medium 304 by the writing unit 228. When the banknotes have been stored in the storage cassette 300 as the proceeds of the store 420, the operator takes out the storage cassette 300 from the cassette mounting unit 226 (STEP4). Thereafter, the operator carries the storage cassette 300 to the money depositing/dispensing machine 100 disposed in the back office region from the money change machine 200 disposed in the front region (STEP5), and the storage cassette 300 is mounted to the cassette mounting unit 126 in the banknote handling assembly 110 of the money depositing/dispensing machine 100 (STEP6).

When the storage cassette 300 has been mounted to the cassette mounting unit 126 in the banknote handling assembly 110 of the money depositing/dispensing machine 100, the information memorized in the storage medium 304 disposed at the storage cassette 300 is read by the reading unit 129 disposed at the cassette mounting unit 126 (STEP7). Specifically, various information including information on an inventory amount of money in the money change machine 200, and information on banknotes stored in the storage cassette 300 is read by the reading unit 129, and the information read by the reading unit 129 is transmitted to the control unit 102 of the money depositing/dispensing machine 100. The inventory amount management unit 107 manages the inventory amount (specifically, an inventory amount of banknotes in the banknote handling assembly 210, an inventory amount of coins in the coin handling assembly 250, and an inventory amount of coin rolls in the coin roll storage assembly 280) of the money in the money change machine 200, based on the information read by the reading unit 129. Furthermore, in a state where the storage cassette 300 is mounted to the cassette mounting unit 126 in the banknote handling assembly 110 of the money depositing/dispensing machine 100, the banknotes are fed out from the storage cassette 300 to the transport unit 130 of the banknote handling assembly 110, and the banknotes are transported to the banknote storage units 134 and 136, and the collection cassette 140 by the transport unit 130, and stored in the banknote storage units 134 and 136, and the collection cassette 140 (STEP8). In a case where coins or coin rolls are collected as money of the proceeds of the store 420 from the money change machine 200, and stored in the money depositing/dispensing machine 100, the operator stores, by her/his hand, coins dispensed from the coin handling assembly 250 or the coin rolls taken out from the coin roll storage assembly 280, in, for example, a storage case, and carries the storage case itself from the money change machine 200 to the money depositing/dispensing machine 100, and the coins or the coin rolls are taken out from the storage case, and deposited in the coin handling assembly 150 of the money depositing/dispensing machine 100 or stored in the coin roll storage assembly 180 of the money depositing/dispensing machine 100. Thus, the money collected from the money change machine 200 as the proceeds of the store 420 is stored in the money depositing/dispensing machine 100.

Furthermore, as described above, information on an amount of money set to be left for each denomination as a change fund in the money change machine 200 is memorized in the memory unit 106 of the money depositing/dispensing machine 100. The calculation unit 108 calculates an amount of money, for each denomination, as change replenishment money to be deposited in the money change machine 200, on the basis of the inventory amount of money, in the money change machine 200, managed by the inventory amount management unit 107, and the above-described information stored in the memory unit 106. Furthermore, the information on the amount of money, as the change replenishment money, calculated by the calculation unit 108 for each denomination is displayed on the operation/display unit 104. Thus, when the operator views the display screen of the operation/display unit 104, the operator is allowed to recognize the information on the amount of money for each denomination as the change replenishment money. Furthermore, a confirmation button for confirming that the money as the change replenishment money to be deposited in the money change machine 200 is to be dispensed from the money depositing/dispensing machine 100 is displayed on the operation/display unit 104. When the operator presses the confirmation button displayed on the operation/display unit 104, the amount of money, for the change replenishment money, calculated by the calculation unit 108 for each denomination, is dispensed from the money depositing/dispensing machine 100. In another example, in the money depositing/dispensing machine 100, when the storage cassette 300 is mounted to the money depositing/dispensing machine 100, and the storage medium 304 is read by the reading unit 129, the amount of money, for the change replenishment money, calculated by the calculation unit 108 for each denomination may be immediately dispensed from the money depositing/dispensing machine 100.

Furthermore, in the present embodiment, the money depositing/dispensing machine 100 may operate such that the calculation unit 108 calculates the number of loose coins, for each denomination, as change replenishment money to be deposited in the money change machine 200, on the basis of an inventory amount of coins, in the coin handling assembly 250 of the money change machine 200, read from the storage medium 304 by the reading unit 129, and the information stored in the memory unit 106, and coin rolls for the change replenishment money are dispensed from the money depositing/dispensing machine 100 on the basis of the calculation result by the calculation unit 108. In this case, the calculation unit 108 can calculate the number of coins, for each denomination, as change replenishment money to be deposited in the money change machine 200, subject to the coin rolls dispensed as the change replenishment money from the money depositing/dispensing machine 100 being unwrapped into loose coins, and the loose coins being deposited as the change replenishment money in the coin handling assembly 250 of the money change machine 200.

Furthermore, in a case where banknotes are included in the money, for the change replenishment money to be deposited in the money change machine 200, which is calculated by the calculation unit 108, the banknotes for the change replenishment money are stored in the storage cassette 300 mounted to the cassette mounting unit 126 (STEP9). Specifically, among banknotes stored in the banknote storage units 134 and 136, banknotes as the change replenishment money to be deposited in the money change machine 200 are fed out from the banknote storage units 134 and 136 to the transport unit 130 by the banknote feeding mechanisms 135 and 137, respectively, and transported to the storage cassette 300 mounted to the cassette mounting unit 126 by the transport unit 130. Furthermore, according to the calculation result by the calculation unit 108, in a case where coin rolls are included in the money as the change replenishment money to be deposited in the money change machine 200, locking of the drawer unit 182 by the locking mechanism 184 is canceled, and the operator is allowed to take out the coin rolls from the drawer unit 182 by drawing the drawer unit 182 from the housing 101. In another example, according to the calculation result by the calculation unit 108, in a case where coin rolls are included in the money as the change replenishment money to be deposited in the money change machine 200, the drawer unit 182 may be automatically drawn from the housing 101. As described above, the coin roll storage assembly 180 includes the weight measurement unit 186 for measuring the weight of coin rolls stored in each of the storage regions 180*a* to 180*f* of the drawer unit 182. Therefore, the number of coin rolls, for each denomination, taken out from the drawer unit 182 is detected based on the weight of the coin rolls measured by the weight measurement unit 186. Furthermore, according to the calculation result by the calculation unit 108, in a case where loose coins are included in the money for the change replenishment money to be deposited in the money change machine 200, loose coins are dispensed from the coin handling assembly 150.

Furthermore, when money for the change replenishment money to be deposited in the money change machine 200 is dispensed from the money depositing/dispensing machine 100, the writing unit 128 writes, in the storage medium 304, various information including information (specifically, the number of banknotes for each denomination, the number of coins for each denomination, and the number of coin rolls of for each denomination, as the change replenishment money) on money for the change replenishment money (STEP10). At this time, although only banknotes are stored in the storage cassette 300, information on the number of banknotes for each denomination, the number of coins for each denomination, and the number of coin rolls for each denomination, as the change replenishment money, is written in the storage medium 304 by the writing unit 228. Furthermore, in a case where money for the change replenishment money to be deposited in the money change machine 200 is dispensed from the money depositing/dispensing machine 100, when abnormality such as jamming of a banknote or a coin occurs in the banknote handling assembly 110 or the coin handling assembly 150, information on an amount of money, for each denomination, which cannot be dispensed by the banknote handling assembly 110 or the coin handling assembly 150 is written in the storage medium 304 by the writing unit 128. In this case, by the storage cassette 300 being inserted in another one of the money depositing/dispensing machines 100, the banknotes as the change replenishment money which cannot be stored in the storage cassette 300 from the money depositing/dispensing machine 100 in which the abnormality has occurred, can be stored in the storage cassette 300 from the other one of the money depositing/dispensing machines 100.

In the money depositing/dispensing machine 100, when the banknotes as the change replenishment money to be deposited in the money change machine 200 have been stored in the storage cassette 300, the operator takes out the storage cassette 300 from the cassette mounting unit 126 (STEP11). Thereafter, the operator carries the storage cassette 300 from the money depositing/dispensing machine 100 disposed in the back office region to the money change machine 200 disposed in the front region (STEP12), and mounts the storage cassette 300 to the cassette mounting unit 226 in the banknote handling assembly 210 of the money change machine 200 (STEP13).

When the storage cassette 300 has been mounted to the cassette mounting unit 226 in the banknote handling assembly 210 of the money change machine 200, information stored in the storage medium 304 disposed at the storage cassette 300 is read by the reading unit 229 disposed at the cassette mounting unit 226 (STEP14). Specifically, various information including information on money as the change replenishment money to be deposited in the money change machine 200 is read by the reading unit 229, and the information read by the reading unit 229 is transmitted to the higher-ranking control unit 202 of the money change machine 200. Furthermore, information on money that includes coins, banknotes, and coin rolls dispensed by the money depositing/dispensing machine 100 is displayed, based on the information read by the reading unit 229, on the operation/display unit 204 of the money change machine 200. Thus, when the operator views the information displayed on the operation/display unit 204, the operator is allowed to recognize the information on money including the coins, banknotes, and coin rolls dispensed from the money depositing/dispensing machine 100. Furthermore, the dispensed money information management unit 206 manages information on money that includes the coins, banknotes, and coin rolls dispensed by the money depositing/dispensing machine 100, based on the information read by the reading unit 229.

Furthermore, in a state where the storage cassette 300 is mounted to the cassette mounting unit 226 in the banknote handling assembly 210 of the money change machine 200, banknotes are fed out from the storage cassette 300 to the transport unit 230 of the banknote handling assembly 210, and the banknotes are stored as a change fund in the banknote storage units 234, 236, and 238 by the transport unit 230 (STEP15).

In a case where coins or coin rolls are dispensed from the money depositing/dispensing machine 100 as money for a change fund with which the money change machine 200 is to be replenished, and stored in the money change machine 200, the operator stores, by his/her hand, coins dispensed from the coin handling assembly 150 or coin rolls taken out from the coin roll storage assembly 180, in, for example, a storage case or the like, and the storage case itself is carried from the money depositing/dispensing machine 100 to the money change machine 200, and the coins or the coin rolls are taken out from the storage case, and deposited in the coin handling assembly 250 of the money change machine 200 or stored in the coin roll storage assembly 280 of the money change machine 200. Furthermore, in a case where the storage cassette 300 is mounted to the cassette mounting unit 226 in the banknote handling assembly 210 of the money change machine 200, and information memorized in the storage medium 304 disposed at the storage cassette 300 is read by the reading unit 229 disposed at the cassette mounting unit 226, when information indicating that at least one coin roll is included in the money dispensed from the money depositing/dispensing machine 100 is read from the storage medium 304 by the reading unit 229, locking of the storage drawer 282 by the locking mechanism 286 is canceled, and the operator is allowed to draw the storage drawer 282 from the housing 281, and the coin rolls can be stored in the storage drawer 282. In another example, when information indicating that at least one coin roll is included in money dispensed from the money depositing/dispensing machine 100 is read from the storage medium 304 by the reading unit 229, the storage drawer 282 may be automatically drawn from the housing 281. Furthermore, the detection unit 284 detects the number of coin rolls for change replenishment money stored in the storage drawer 282 for each denomination. Thus, money as the change fund with which the money change machine 200 is to be replenished, is dispensed from the money depositing/dispensing machine 100, and stored in the money change machine 200.

Furthermore, the comparison unit 205 performs comparison between an amount of money, for each denomination, as the change replenishment money deposited in the money change machine 200, and an amount of money for each denomination as change replenishment money based on the information read from the storage medium 304 by the reading unit 229. When both the amounts of money for each denomination do not coincide with each other, a warning message is displayed on the operation/display unit 204 disposed at the money change machine 200 or the display unit 293 of the POS register 290 so as to indicate that all the money dispensed from the money depositing/dispensing machine 100 is not deposited in the money change machine 200.

Furthermore, after money as change replenishment money dispensed from the money depositing/dispensing machine 100 is stored in the money change machine 200, the determination unit 209 disposed in the money change machine 200 determines whether or not the number of coin rolls, for each denomination, deposited in the storage drawer 282 and detected by the detection unit 284 coincides with the number of coin rolls, for each denomination, dispensed from the money depositing/dispensing machine 100 and read from the storage medium 304 by the reading unit 229. When both the numbers of coin rolls do not coincide with each other, a warning message is displayed on the operation/display unit 204 disposed at the money change machine 200 or the display unit 293 of the POS register 290 so as to indicate that all the coin rolls taken out from the coin roll storage assembly 180 of the money depositing/dispensing machine 100 by the operator, are not stored in the coin roll storage assembly 280 of the money change machine 200. Furthermore, when both the numbers of coin rolls do not coincide with each other, even if the storage drawer 282 is returned into the housing 281, locking may not be performed by the locking mechanism 286. In the money change machine 200, in a case where the determination unit 209 determines that the number of coin rolls, for each denomination, deposited in the storage drawer 282 and detected by the detection unit 284 does not coincide with the number of coin rolls, for each denomination, dispensed from the money depositing/dispensing machine 100 and read by the reading unit 229, it may be determined, based on the counting result by the recognition unit 256, whether or not the number of loose coins corresponding to the number of coin rolls which is obtained by subtracting the number of coin rolls, for each denomination, deposited in the storage drawer 282 and detected by the detection unit 284, from the number of coin rolls, for each denomination, dispensed from the money depositing/dispensing machine 100 and read by the reading unit 229, is deposited in the coin handling assembly 250 of the money change machine 200. In this case, also in a case where the operator unwraps (specifically, the operator tears the wrapping paper of the coin rolls) the wrapping of coin rolls dispensed from the money depositing/dispensing machine 100 into loose coins, and the loose coins are deposited in the coin handling assembly 250 of the money change machine 200, whether or not the operator has stored all the coin rolls as the change replenishment money dispensed from the money depositing/dispensing machine 100, as the loose coins or the coin rolls, in the money change machine 200, can be detected.

Thereafter, when, in a state where the storage cassette 300 is mounted to the money change machine 200, the money is deposited in the money change machine 200 as the proceeds of the store 420 (STEP16), various information including information on an inventory amount of money in the money change machine 200 is written in the storage medium 304 by the writing unit 228 in the money change machine 200 (STEP17). The operator takes out the storage cassette 300 from the cassette mounting unit 226 (STEP18), and the operator carries the storage cassette 300 having been taken out, from the money change machine 200 disposed in the front region to the money depositing/dispensing machine 100 disposed in the back office region (STEP19), and the operator mounts the storage cassette 300 to the cassette mounting unit 126 in the banknote handling assembly 110 of the money depositing/dispensing machine 100 (STEP20), whereby the reading unit 129 disposed at the cassette mounting unit 126 reads information memorized in the storage medium 304 proposed at the storage cassette 300, in the money depositing/dispensing machine 100 (STEP21). The proceeds management unit 109 manages information on money deposited in the money change machine 200 as the proceeds after the storage cassette 300 is mounted to the money change machine 200 in the process step of STEP13 until the storage cassette 300 is taken out from the money change machine 200 in the process step of STEP18, on the basis of information, on an inventory amount of the money change machine 200, read from the storage medium 304 by the reading unit 129 in the process steps of STEP7 and STEP21, and information on the change replenishment money written in the storage medium 304 by the writing unit 128 in the process step of STEP10 (STEP22). Specifically, as shown in FIG. 15, an amount of money for each denomination as the change replenishment money, written in the storage medium 304 by the writing unit 128 in the process step of STEP10, and an amount of money, for the inventory amount of the money change machine 200 for each denomination, read from the storage medium 304 for the first time, in the process step of STEP7 are subtracted from an amount of money, for the inventory amount of the money change machine 200 for each denomination, read from the storage medium 304 for the second time in the process step of STEP21, whereby an amount of money, for each denomination, deposited in the money change machine 200 as the proceeds is calculated.

In the money management system 1, according to the present embodiment, having the above-described configuration, and the money management method performed by the money management system 1, the money change machine 200 (first money handling apparatus) has the writing unit 228 (first writing unit) that writes, in the storage medium 304 disposed at the storage cassette 300, information on an inventory amount of money for the money change machine 200 when the storage cassette 300 is mounted to the money change machine 200 (specifically, the cassette mounting unit 226 of the banknote handling assembly 210), and the money depositing/dispensing machine 100 (second money handling apparatus) has the reading unit 129 (second reading unit) that reads information from the storage medium 304 disposed at the storage cassette 300 when the storage cassette 300 is mounted to the money depositing/dispensing machine 100 (specifically, the cassette mounting unit 126 of the banknote handling assembly 110), and the inventory amount management unit 107 that manages an inventory amount of money for the money change machine 200 based on the information read by the reading unit 129. As described above, in the present embodiment, information on an inventory amount of money in the money change machine 200 is written in the storage medium 304 disposed at the storage cassette 300 that is detachably mounted to the money change machine 200 and the money depositing/dispensing machine 100, whereby an inventory amount of money in the money change machine 200 can be managed off-line by the money depositing/dispensing machine 100 without using a data management device, thereby reducing the cost for installation and the cost for maintenance for the entirety of the system.

The money management system 1 according to the present embodiment and the money depositing/dispensing machine 100 and the money change machine 200 disposed in the money management system 1 are not limited to the above-described aspect, and various modifications can be made.

For example, in the money change machine 200, when banknotes are stored in the storage cassette 300 as proceeds of the store 420, the writing unit 228 may write, in the storage medium 304 disposed at the storage cassette 300, information on an insufficient money amount for each denomination as a change fund in the money change machine 200 instead of the information on an inventory amount of money in the money change machine 200. In this case, banknotes are stored in the storage cassette 300 as proceeds of the store 420, and an operator takes out the storage cassette 300 from the cassette mounting unit 226, and the storage cassette 300 is then mounted to the cassette mounting unit 126 in the banknote handling assembly 110 of the money depositing/dispensing machine 100. At this time, information (specifically, information on an insufficient money amount for each denomination as a change fund in the money change machine 200) stored in the storage medium 304 disposed at the storage cassette 300 is read by the reading unit 129 disposed at the cassette mounting unit 126. Furthermore, in the money management system 1 according to the modification, the change replenishment money management unit 107*a* that manages an amount of money, for each denomination, as the change replenishment money to be deposited in the money change machine 200, on the basis of the information read by the reading unit 129, is disposed in the money depositing/dispensing machine 100. After banknotes stored in the storage cassette 300 as proceeds are stored in the banknote handling assembly 110, information on the amount of money, for each denomination, to be deposited in the money change machine 200 as the change replenishment money and which is managed by the change replenishment money management unit 107*a*, is displayed. Thus, the operator views the display screen of the operation/display unit 104, whereby the operator is allowed to recognize the information on the amount of money, for each denomination, to be deposited in the money change machine 200 as the change replenishment money. Furthermore, a confirmation button for confirming that the money is to be dispensed from the money depositing/dispensing machine 100 as the change replenishment money to be deposited in the money change machine 200 is displayed on the operation/display unit 104. When the operator presses the confirmation button displayed on the operation/display unit 104, an amount of money, for each denomination, managed by the change replenishment money management unit 107*a* is dispensed from the money depositing/dispensing machine 100 as the change replenishment money. In another example, in the money depositing/dispensing machine 100, when the storage cassette 300 is mounted to the money depositing/dispensing machine 100 and the storage medium 304 is read by the reading unit 129, an amount of money, for each denomination, managed by the change replenishment money management unit 107*a* may be immediately dispensed from the money depositing/dispensing machine 100 as the change replenishment money.

Furthermore, in a case where money, for change replenishment money to be deposited in the money change machine 200, managed by the change replenishment money management unit 107*a* includes a banknote, the banknote for the change replenishment money is stored in the storage cassette 300 mounted to the cassette mounting unit 126. Furthermore, in a case where money, for the change replenishment money to be deposited in the money change machine 200, managed by the change replenishment money management unit 107*a* includes coin rolls, locking of the drawer unit 182 by the locking mechanism 184 is canceled, and an operator is allowed to take out coin rolls from the drawer unit 182 by drawing the drawer unit 182 from the housing 101. In another example, in a case where money, for the change replenishment money to be deposited in the money change machine 200, managed by the change replenishment money management unit 107*a* includes coin rolls, the drawer unit 182 may be automatically drawn from the housing 101. Furthermore, in a case where money, for the change replenishment money to be deposited in the money change machine 200, managed by the change replenishment money management unit 107*a* includes loose coins, the loose coins are dispensed from the coin handling assembly 150.

Furthermore, in the money management system 1 according to another modification, various information such as information on an inventory amount of money in the money depositing/dispensing machine 100 or the money change machine 200, or information on banknotes stored in the storage cassette 300 may be written in an ID card carried by an operator such as a clerk, instead of the information being written in the storage medium 304 disposed at the storage cassette 300. In the money management system 1 according to this modification, when money is collected from the money change machine 200 as proceeds, an operator inserts the ID card in the card reader 296 of the POS register 290, whereby various information including information on an inventory amount of money in the money change machine 200 or information on banknotes stored in the storage cassette 300 is written in the ID card. Furthermore, when money collected from the money change machine 200 as the proceeds is deposited in the money depositing/dispensing machine 100, the operator inserts the ID card in a card reader (not shown) disposed at the money depositing/dispensing machine 100, whereby various information, stored in the ID card, including information on an inventory amount of money in the money change machine 200, or information on banknotes stored in the storage cassette 300 are read, and the read information is transmitted to the control unit 102. Furthermore, when money as the change replenishment money to be deposited in the money change machine 200 is dispensed from the money depositing/dispensing machine 100, the operator inserts the ID card in the card reader (not shown) disposed at the money depositing/dispensing machine 100, whereby various information including information on money as the change replenishment money dispensed from the money depositing/dispensing machine 100 is written in the ID card. Furthermore, when money as the change replenishment money dispensed from the money depositing/dispensing machine 100 is deposited in the money change machine 200, the operator inserts the ID card in the card reader 296 of the POS register 290, whereby various information including information, on money as the change replenishment money, stored in the ID card is read, and the read information is transmitted from the POS control unit 291 of the POS register 290 to the higher-ranking control unit 202 of the money change machine 200. Thus, in the money management system 1 according to the above-described modification, various information can be exchanged between the money depositing/dispensing machine 100 and the money change machine 200 without using the storage medium 304 disposed at the storage cassette 300.

Furthermore, in the money depositing/dispensing machine 100 of the money management system 1 according to still another modification, when the storage cassette 300 is mounted to the cassette mounting unit 126, the storage cassette 300 may be used as a banknote storage unit for recycling. That is, since the storage cassette 300 mounted to the cassette mounting unit 126 can store banknotes inside the housing 101 and can feed out the banknotes stored therein, the storage cassette 300 has the same function as the banknote storage units 134 and 136. Furthermore, in a case where the storage cassette 300 mounted to the cassette mounting unit 126 is used as a banknote storage unit for recycling, a denomination for banknotes to be stored in the storage cassette 300 can be assigned, similarly to the banknote storage units 134 and 136.

Furthermore, in the money management system 1 according to still another modification, when money is collected from the money change machine 200 as proceeds of the store 420, information on money collected from the money change machine 200 as proceeds may be written by the writing unit 228 in the storage medium 304 disposed at the storage cassette 300 which is mounted to the cassette mounting unit 226. In this case, banknotes are stored in the storage cassette 300 as proceeds of the store 420, the storage cassette 300 is taken out from the cassette mounting unit 226 by an operator, and the storage cassette 300 is then mounted to the cassette mounting unit 126 in the banknote handling assembly 110 of the money depositing/dispensing machine 100. At this time, information (specifically, information on money collected from the money change machine 200 as proceeds) stored in the storage medium 304 disposed at the storage cassette 300 is read by the reading unit 129 disposed at the cassette mounting unit 126. Furthermore, the information ready by the reading unit 129 is transmitted to the control unit 102. In the money depositing/dispensing machine 100, information, on money collected from the money change machine 200 as proceeds, read by the reading unit 129 is determined as being correct, and information on money collected from the money change machine 200 as proceeds can be managed in the control unit 102 without counting banknotes and coins deposited in the banknote handling assembly 110 and the coin handling assembly 150. Alternatively, the recognition units 132 and 156 may count banknotes and coins deposited in the banknote handling assembly 110 and the coin handling assembly 150, and the control unit 102 may perform comparison between a result of counting the deposited money by the recognition units 132 and 156, and information, on money collected from the money change machine 200 as proceeds, read by the reading unit 129. In this case, in a case where both the result and the information do not coincide with each other, a warning message is displayed on the operation/display unit 104 so as to indicate that all the money collected from the money change machine 200 as proceeds is not deposited in the money depositing/dispensing machine 100. In the money management system 1 according to this modification, banknotes collected from the money change machine 200 as proceeds can be deposited in the money depositing/dispensing machine 100 so as not to be touched by a hand of an operator, thereby enhancing security. Furthermore, information on money collected from the money change machine 200 as proceeds can be assuredly managed by the money depositing/dispensing machine 100.

Furthermore, in the money management system 1 according to still another modification, a coin storage cassette for storing coins and feeding out the coins stored therein may be detachably mounted to each of the money depositing/dispensing machine 100 and the money change machine 200. In this case, coins can be exchanged, by using such a coin storage cassette, between the money depositing/dispensing machine 100 and the money change machine 200, so that coins collected from the money change machine 200 as proceeds or coins which are dispensed from the money depositing/dispensing machine 100 and with which the money change machine 200 is to be replenished as change replenishment money can be prevented from being touched by a hand of an operator, thereby enhancing security. Furthermore, the storage medium 304 described above may be disposed at such a coin storage cassette for storing coins.

Furthermore, in another example, in the money depositing/dispensing machine 100, banknotes fed out from the storage cassette 300 mounted to the cassette mounting unit 126 may not be recognized, and only the number of the banknotes may be counted. In this case, the counted number of the banknotes and the number of banknotes stored in the storage medium 304 disposed at the storage cassette 300 may be compared with each other. When both the numbers of banknotes do not coincide with each other, it may be indicated on the operation/display unit 104 or the like that both the numbers of banknotes do not coincide with each other.

Furthermore, in the money depositing/dispensing machine 100, in a case where a banknote fed out from the storage cassette 300 mounted to the cassette mounting unit 126 is recognized to be not a normal banknote (that is, rejected banknote) by the recognition unit 132, such a banknote may be stored in the dispensing reject unit 124 or the collection cassette 140, and the banknote which is not normal may be specified based on the information stored in the storage medium 304 disposed at the storage cassette 300. Furthermore, in this case, the storage medium 304 may be overwritten, by the writing unit 128, with information on the banknote which is recognized to be not a normal banknote, on the basis of the recognition result by the recognition unit 132. Furthermore, in a case where the denominations and the number of banknotes which are recognized to be not normal by the recognition unit 132 are manually inputted to the operation/display unit 104 or the like, an input operation can be reduced by the denominations and the number of rejected banknotes being reflected in the manually inputted items.

The invention claimed is:

1. A money management system comprising:

a first money handling apparatus configured to perform depositing of money received for a commodity or to perform dispensing of money as change, the first money handling apparatus being configured to store money as change funds in advance at a start of business hours;

a second money handling apparatus configured to perform depositing of money collected from the first money handling apparatus as proceeds or to perform dispensing of money as change replenishment money to be replenished into the first money handling apparatus; and a storage cassette configured to store money and feed out the stored money, the storage cassette having a storage medium and being capable to be detachably mounted to each of the first money handling apparatus and the second money handling apparatus, wherein the second money handling apparatus has a second reading unit configured to read the information written in the storage medium when the storage cassette is mounted to the second money handling apparatus, an inventory amount management unit configured to manage an inventory amount of money being in the first money handling apparatus based on the information read by the second reading unit, a memory unit configured to store information on an amount of money for each denomination as the change fund in the first money handling apparatus, and a calculation unit configured to calculate for each denomination, an amount of money as the change replenishment money to be deposited in the first money handling apparatus, based on an inventory amount of money being in the first money handling apparatus and managed by the inventory amount management unit, and the information stored in the memory unit.

2. The money management system according to claim 1, wherein the second money handling apparatus further comprising a display unit that displays information on an amount of money for each denomination calculated by the calculation unit as the change replenishment money and receives a dispensing instruction, and when the storage cassette is mounted to the second money handling apparatus, the second money handling apparatus dispenses an amount of money for each denomination, calculated by the calculation unit as the change replenishment money, if receiving the dispensing instruction after information on the amount of money for each denomination as the change replenishment money is displayed on the display unit.

3. The money management system according to claim 2, wherein the second money handling apparatus causes the storage cassette to store money dispensed from the second money handling apparatus as the change replenishment money.

4. The money management system according to claim 1, wherein when the storage cassette is mounted to the second money handling apparatus, the second money handling apparatus dispenses an amount of money for each denomination calculated by the calculation unit as the change replenishment money after information is read from the storage medium by the second reading unit.

5. The money management system according to claim 1, wherein the second money handling apparatus further comprising a second writing unit that writes information on the change replenishment money calculated by the calculation unit, in the storage medium disposed at the storage cassette when the storage cassette is mounted to the second money handling apparatus.

6. The money management system according to claim 5, wherein the second money handling apparatus further comprises a proceeds management unit that manages information on money deposited in the first money handling apparatus as proceeds based on information on an inventory amount of money being in the first money handling apparatus, read from the storage medium by the second reading unit, and information on the change replenishment money written in the storage medium by the second writing unit.

7. The money management system according to claim 1, wherein the first money handling apparatus further includes:

a first writing unit configured to write information on an inventory amount of money being in the first money handling apparatus in the storage medium when the storage cassette is mounted to the first money handling apparatus, and a first reading unit that reads information on change replenishment money from the storage medium disposed at the storage cassette when the storage cassette is mounted to the first money handling apparatus.

8. The money management system according to claim 7, wherein the first money handling apparatus further comprises a comparison unit that performs comparison between an amount of money for each denomination deposited in the first money handling apparatus as the change replenishment money, and an amount of money for each denomination as the change replenishment money based on the information read from the storage medium by the first reading unit.

9. The money management system according to claim 7, wherein, the storage cassette stores a banknote, the first writing unit of the first money handling apparatus writes, in the storage medium disposed at the storage cassette information on inventory amounts of banknotes and coins being in the first money handling apparatus when the storage cassette is mounted to the first money handling apparatus, the second reading unit of the second money handling apparatus reads from the storage medium disposed at the storage cassette information on inventory amounts of banknotes and coins in the first money handling apparatus when the storage cassette is mounted to the second money handling apparatus, and the inventory amount management unit of the second money handling apparatus manages inventory amounts of banknotes and coins being in the first money handling apparatus based on the information read by the second reading unit.

10. The money management system according to claim 7, wherein the first writing unit of the first money handling apparatus also writes information on a state of the first money handling apparatus, in the storage medium disposed at the storage cassette, when the storage cassette is mounted to the first money handling apparatus.

11. The money management system according to claim 1, wherein when the storage cassette is mounted to the first money handling apparatus, a first portion of the money is left in the first money handling apparatus as the change fund and a second portion of the money other than the first portion is stored in the storage cassette from the first money handling apparatus, and when the storage cassette storing the second portion of the money is mounted to the second money handling apparatus, the second portion of the money stored in the storage cassette is collected into the second money handling apparatus.

* * * * *